US005172717A

United States Patent [19]

Boyle et al.

[11] Patent Number: 5,172,717

[45] Date of Patent: Dec. 22, 1992

[54] WELL CONTROL SYSTEM

[75] Inventors: William G. Boyle; John J. Goiffon, both of Dallas; Charles M. Pool, Euless, all of Tex.

[73] Assignee: Otis Engineering Corporation, Dallas, Tex.

[21] Appl. No.: 621,295

[22] Filed: Nov. 30, 1990

Related U.S. Application Data

[63] Continuation-in-part of Ser. No. 457,520, Dec. 27, 1989.

[51] Int. Cl.[5] ..... F04F 1/20

[52] U.S. Cl. ..... 137/155; 137/487.5; 417/109; 417/110

[58] Field of Search ..... 137/155, 487.5; 417/109, 110; 73/151, 155; 340/856; 116/316

[56] References Cited

U.S. PATENT DOCUMENTS

| | | | |
|---|---|---|---|
| 2,245,005 | 6/1941 | Nixon | 417/110 |
| 2,703,532 | 5/1955 | Bobo | 137/155 X |
| 2,759,429 | 8/1956 | Bubb | 137/155 X |
| 2,808,781 | 10/1957 | Garrett et al. | 417/109 X |
| 2,869,475 | 1/1959 | Bobo | 137/155 X |
| 2,876,703 | 3/1959 | Carlisle et al. | 417/109 X |
| 3,427,989 | 2/1969 | Bobstock et al. | 137/155 X |
| 4,035,103 | 7/1977 | McMurry et al. | 417/109 |
| 4,110,057 | 8/1978 | McMurry et al. | 417/109 |
| 4,568,933 | 2/1986 | McCracken et al. | 73/155 |
| 4,791,954 | 12/1988 | Hasegawa | 137/487.5 |

*Primary Examiner*—John Rivell
*Attorney, Agent, or Firm*—Johnson & Gibbs

[57] ABSTRACT

An electrically actuated downhole system for controlling and monitoring the flow of gas from a gas lift petroleum well in which a borehole penetrates at least two spacially separated geological production zones, and at least two strings of parallel tubing extend along the interior of a well casing, each string being associated with a separate production zone. Connected to each string is a gas lift valve associated with the string's respective spacially separated production zone. A single source of pressurized gas is connected to the casing at the wellhead to provide a source of lift gas. A control unit located at the surface independently controls and monitors the size of the flow control aperture of each gas lift valve to control the production of fluids from each separate production zone. Control cables carry readings from downhole pressure and flow-rate sensors to the control unit, and in response, carry control signals back to each gas lift valve to control its aperture size.

46 Claims, 14 Drawing Sheets

VALVE POSITION SIGNAL

PRESSURE TRANSDUCER SIGNAL

COMBINED SIGNAL

WELL CONTROL SYSTEM

BACKGROUND OF THE INVENTION

This application is a continuation-in-part application of U.S. patent application Ser. No. 457,520, filed Dec. 27, 1989, and entitled Flow Control Valve System.

FIELD OF THE INVENTION

The invention relates to well production control systems, and more particularly, to an electrically actuated downhole control and monitoring system.

HISTORY OF THE PRIOR ART

In the operation of petroleum production walls, it is necessary to provide valves located within the production equipment down in a borehole for the control of various functions in the well. For example, in the operation of a gas lift well, it is necessary to selectively introduce the flow of high pressure gas to the tubing of a well in order to clear the accumulated borehole fluids from within the well and allow the flow of fluids from the production zone of the producing formation into the well tubing and to the surface for collection. Periodically, a mixture of oil and water collects in the bottom of the wall casing and tubing in the region of the producing formation and obstructs the flow of gases to the surface. In a "gas lift" well completion high pressure gas from an external source is injected into the well in order to lift the borehole fluids collected in the well tubing to the surface to "clear" the well and allow the free flow of production fluids to the surface. This injection of gas into the well requires the operation of a valve controlling that injection gas flow known as a gas lift valve. Gas lift valves are conventionally normally closed restricting the flow of injection gas from the casing into the tubing and are opened to allow the flow of inject gas in response to either a preselected pressure condition or control from the surface. Generally such surface controlled valves are hydraulically operated. By controlling the flow of a hydraulic fluid from the surface, a poppet valve is actuated to control the flow of fluid into the gas lift valve. The valve is moved from a closed to an open position for as long as necessary to effect the flow of the lift gas. Such valves are also position instable. That is, upon interruption of the hydraulic control pressure, the gas lift valve returns to its normally closed configuration.

A difficulty inherent in the use of gas lift valves which are either full open or closed is that gas lift production completions are a closed fluid system which are highly elastic in nature due to the compressibility of the fluids and the frequently large depth of the wells. For this reason, and especially in the case of dual completion wells, the flow of injected gas through a full open gas lift valve may produce vibrations at a harmonic frequency of the closed system and thereby create resonant oscillations in the system generating destructive forces within the production equipment. Gas lift valves of a particular size aperture positioned at a point of resonance within the well completion(s) may have to be replaced in order for the system to be operable.

While electrically controlled gas lift valves are also available, for example as shown in U.S. Pat. No. 3,427,989, assigned to the assignee of the present invention, they include the disadvantages of other gas lift valves which are position instable and which operate based upon either full open or full closed conditions.

Another application of downhole fluid control valves within a production well is that of chemical injection. In some wells, it becomes necessary to inject a flow of chemicals into the borehole in order to treat either the well production equipment or the formation surrounding the borehole. The introduction of chemicals through a downhole valve capable of only full open or full closed condition does not allow precise control over the quantity of chemicals injected into the well.

Another application for downhole flow control valves incorporating the present invention is in producing wells completed for dual gas lift operations. Such wells are typically defined by a wellbore lined with a casing string that penetrates two independent underground hydrocarbon producing formations and has two separated production tubing strings disposed therein to communicate fluids from the respective underground formations to the well surface. The casing and production tubing strings partially define an annulus in the wellbore which can be used to receive and store lift gas prior to injection into the tubing strings. Each underground formation generally has its own unique reservoir characteristics of permeability, viscosity, pressure, etc. which dictate a unique gas lift injection pressure and flow rate for optimum production of formation fluids. Wells communicating with the same producing formation may also require different gas lift injection pressures and flow rates for optimum production from each well. The present invention allows varying the orifice size of the gas injection valve in each tubing string for optimum production from the respective underground formation even though the lift gas is supplied to both tubing strings from a common source—the well annulus. Flow control valves which are either full open or full closed do not allow for precise control of lift gas from the same source into separate tubing strings. As previously noted, systems with full open or full closed valves are subject to potentially harmful resonance oscillations between gas flow into two separate tubing strings.

As mentioned above, prior art flow control valves for downhole applications, such as gas lift valves, include a number of inherent disadvantages. A first of these is having a single size flow orifice in the open condition which may produce resonant oscillations resulting in destructive effects within the well. A second disadvantage is that of being capable of assuming only a full open or full closed position which requires the shuttling of the valve between these two positions at high pressures and results in tremendous wear and tear on the valves. Such wear requires frequent maintenance and/or replacement of the valves which is extremely expensive. Hydraulically actuated downhole flow control valves also include certain inherent disadvantages as a result of their long hydraulic control lines which result in a delay in the application of control signals to a downhole device. In addition, the use of hydraulic fluids to control valves will not allow transmission of telemetry data from downhole monitors to controls at the surface.

To overcome some of these objections of present downhole flow control valve systems, it would be extremely helpful to be able to provide a downhole valve in which the orifice size of the valve is adjustable through a range of values. This would enable systems such as gas lift systems which are susceptible to resonant oscillation, to be detuned by adjusting the size of the orifice so that the system is no longer resonant. Changing the size of the valve flow control orifice allows the spontaneous generation of oscillations in a closed elastic fluid system to be damped and prevents the necessity of replacing the valve. In addition, such a variable orifice valve would allow much greater control over the quantity and rate of injection of fluids into the well. In particular, more precise control over the flow of injection gas into a dual lift gas lift well completion would allow continuous control of the injection pressure into both strings of tubing from a common annulus. This permits control of production pressures and flow rates within the well and results in more efficient production from the well.

Another desirable characteristic of a downhole flow control valve system would be that of position stability of the flow control orifice. That is, it would be highly useful to be able to set a flow control valve at a particular orifice and to have it remain at that same orifice size until selectively changed to a different size. Position stability is preferable in the absence of any control signals to the valve so that applied power is only necessary to change the orifice from one size to another. Prior art valves which are either open or closed, generally return to the closed state in the absence of control power. Another large advantage which would be highly desirable in downhole flow control valve systems is that of an accurate system for monitoring not only the orifice size of the valve but also the pressures and flow rates within the production system in order to obtain desired production parameters within the well. For example, it would be advantageous to be able to select a particular bottom hole flowing pressure and then control the size of the orifice of the valve in order to obtain that selected value of bottom hole flowing pressure. In addition, it would be desirable to be able to select a given flow rate and then control the size of the orifice of the valve in order to obtain and hold that particular rate of production flow from the well. Similarly, it would be desirable to optimize the size of a downhole gas injection valve opening to dampen fluid/gas surges in a gas injection completion and minimize the variations in production flow from the well. Such systems require a reliable means for both sending data uphole from the vicinity of the valve as well as processing that data and then actively controlling the size of the flow control orifice of the valve in order to obtain the desired results, as monitored by the system. One implementation might include an indicator system for encoding and sending data to the surface related to valve orifice position and downhole pressure and flow information as well as a reliable system for sending signals downhole to selectively adjust the position of the valve.

Remote controlled valves which share a common communications cable to the control location with a system for measuring parameter values have certain inherent problems. The remote parameter measuring circuits must receive a continuous, comparatively low value of current in order to function and the presence of a valve control circuit, such as a solenoid coil, on the same circuit unnecessarily loads the current requirements of the system and wastes power. Similarly, actuation of valve control circuit, such as a solenoid coil, requires a comparatively high value of current in order to move the solenoid armature and such high values of current may well damage the power supplies of the measuring circuits. In addition, it may be desirable to remotely address selected ones of either multiple parameter measuring circuits or valve control circuits within the same flow control system without undue duplication of control and power cabling.

The flow control valve system of the present invention incorporates many of these desired features of a valve system and allows the remote adjustment of selected ones of a plurality of variable orifice size valves by means of signals from the surface and then the maintenance of that orifice size in a position stable configuration until additional signals are sent to change that orifice size. The system also has provisions for monitoring a plurality of parameters down in the well and then controlling the position of the valve in order to effectuate desired changes and/or maintenance in those parameter values. The system is implemented by circuitry which allows a single cable to supply both low voltage continuous operating currents to the monitoring circuits and intermittent higher voltage pulses to the valve orifice adjustment circuits. The system of the invention also allows selective addressing of individual ones of multiple parameter measuring circuits and/or valve control circuits on a single control cable from the remote location.

SUMMARY OF THE INVENTION

In one aspect of the invention includes a method and system for controlling the flow from a gas lift petroleum production well in which a borehole penetrates at least two spacially separated geological production zones. A casing extends from the wellhead to line the borehole and into both of the spacially separated production zones. At least two strings of tubing extend in parallel along the interior of the casing from the wellhead with the first string of tubing extending into the region of the first of the spacially separated production zones and the second string of tubing extending into the region of the second of the production zones. A gas lift valve is connected in each one of the strings of tubing with a first valve being located in the region of the first production zone and a second valve being located in the region of the second production zone. A single source of pressurized gas is connected to the casing at the wellhead to provide a source of lift gas. The size of the flow control aperture within each of the first and second gas lift valves is independently varied to control the production of well fluids from each of the first and second strings of tubing and the common source of pressurized lift gas within the casing.

In another aspect, the invention includes a method and system for controlling the flow from a gas lift petroleum production well in which a casing extends from a wellhead to line the borehole and into a production zone. A string of tubing extends along the interior of the casing from the wellhead into the region of the production zone. A gas lift valve is connected in the string of tubing and located in the region of the production zone. A source of pressurized gas is connected to the casing at the wellhead to provide a source of lift gas. Production fluid flow from the tubing at the surface is monitored and the size of the flow control aperture within the gas lift valve is varied in response to the rate of production flow from the tubing to control the production of well fluids from the string of tubing and minimize the fluctuations in the production flow rate.

In a further aspect, the invention includes a system for monitoring downhole variable parameters within a petroleum production well. A control unit is located at the surface for producing control signals and for receiving signals indicative of monitored parameter values while a plurality of sensors are located downhole for generating a signal related to the value of a variable parameter. A cable extends down the well for connecting all of the plurality of sensors to the control unit at the surface. An address control switch is associated with each one of said plurality of sensors and connected to the cable. Each one of the address control switches has a unique address code upon receipt of which it will connect its associated sensor to the cable for electrical communication with the control unit. An address code generator is located within the control unit and connected to the cable for selectively generating control signals containing the address code associated with the address control switch of the particular downhole sensor for the downhole parameter to be monitored at the surface.

In a still further aspect of the invention a system for monitoring and controlling downhole parameters within a petroleum production well includes a first electrical component located downhole which requires a relatively low value of operating voltage and a second electrical component located downhole which requires periodic pulses of a relatively high value of operating voltage. A single cable extends from the surface for supplying operating voltage to both the first and second electrical components. A first circuit is connected between the cable and the first electrical component for allowing a relatively low value of voltage to pass and supply operating power to said component and is responsive to a value of voltage on the cable which is in excess of a threshold value for electrically disconnecting the first component from the cable and responsive to the value of voltage on the cable decreasing in zero for reconnecting the first component to the cable. A second circuit is connected between the cable and the second electrical component for disconnecting the component from the cable to prevent the component from electrically loading the power supply circuit and is responsive to a value of voltage on the cable in excess of a threshold value for electrically connecting the second component to the cable to allow the voltage to pass and operate the component and responsive to the value of voltage on the cable decreasing to zero for disconnecting the second component to the cable.

In another aspect the invention contemplates a system for monitoring and controlling downhole parameters within a petroleum production well including a casing extending from a wellhead to line the borehole and into a production zone. A string of tubing extends along the interior of the casing from the wellhead into the region of the production zone. A valve is connected in the string of tubing and located in the region of the production zone. The size of the flow control aperture within said valve is varied to control the flow of fluids from the casing into the tubing. A signal indicative of the size of the flow control aperture is generated. A control unit is located at the surface for generating control signals and for monitoring the size of the flow control aperture within the valve. A control cable extends down the casing and is connected from the control unit to the valve for coupling control signals from the control unit to the valve to vary the size of the flow control aperture thereof and to couple the size indicative signals from the signal generator to the control unit for monitoring thereof.

BRIEF DESCRIPTION OF THE DRAWINGS

For an understanding of the present invention and for further objects and advantages thereof, reference may now be had to the following description taken in conjunction with the accompanying drawings in which.

DESCRIPTION OF THE PREFERRED EMBODIMENTS

Figure 1:
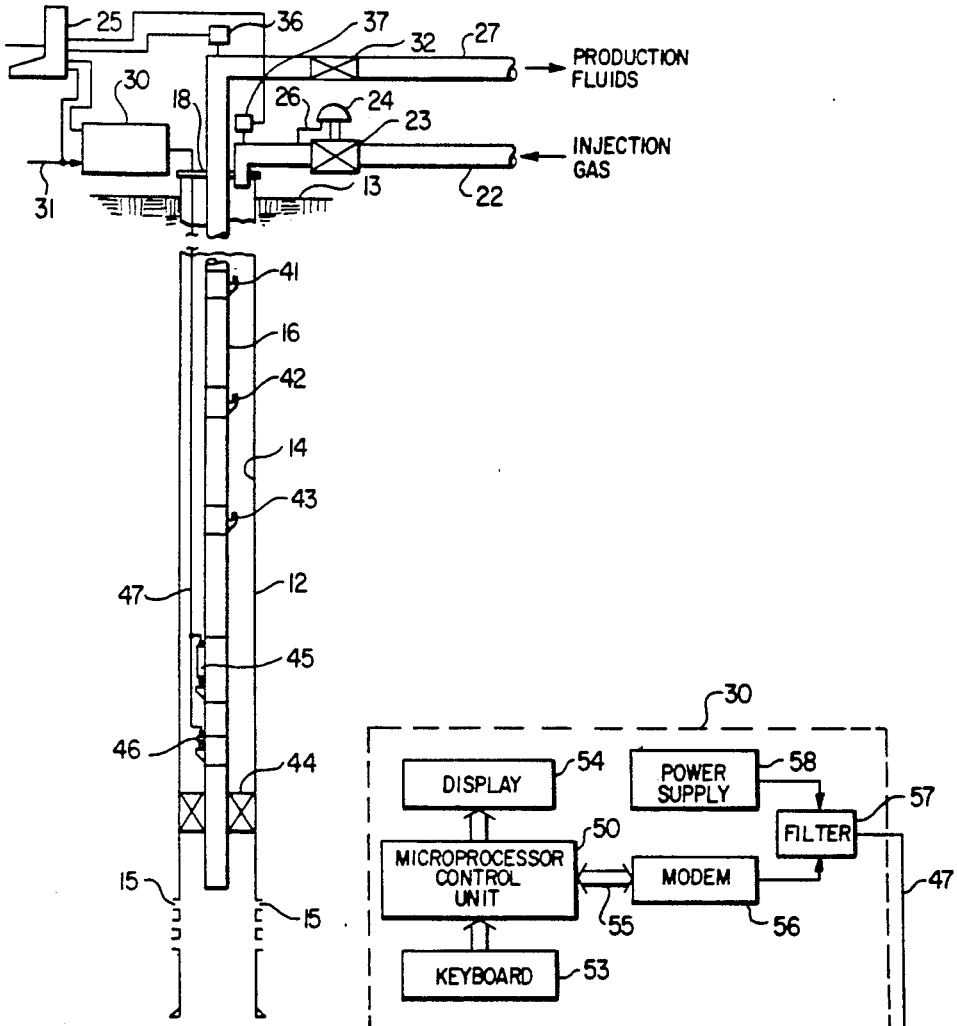
FIG. 1 is a schematic drawing of a gas injection gas lift well completion including a valve system constructed in accordance with the teachings of the aspect of the present invention.

Referring first to FIG. 1, there is shown an illustrative schematic of a producing well equipped as a gas lift completion. The well includes a borehole 12 extending from the surface of the earth 13 which is lined with a tubular casing 14 and extends from the surface down to the producing geological strata. The casing 14 includes perforations 15 in the region of the producing strata to permit the flow of fluid from the formation into the casing lining the borehole. The producing strata into which the borehole and the casing extend is formed of porous rock and serves as a pressurized reservoir containing a mixture of gas, oil and water. The casing 14 is preferably perforated along the region of the borehole containing the producing strata in area 15 in order to allow fluid communication between the strata and the well. A string of tubing 16 extends axially down the casing 14.

Both the tubing and the casing extend into the borehole from a wellhead 18 located at the surface above the well which provides support for the string of tubing 16 extending into the casing 14 and closes the open end of the casing. The casing 14 is connected to a line 22 which supplies high pressure lift gas through a first flow control valve 23 from an external source such as a compressor (not shown) into the casing 14.

The tubing 16 is connected to a production flow line 27 through a second valve 32. The output of the flow line 27 comprises production fluids from the well which are connected to a collection means such as a separator (not shown). The output flow of the tubing 16 into the production flow line 27 is generally a mixture of several fluids, such as oil, water, and condensate, and gas and is directed to a separator which effects the physical separation of the liquids from the gases and passes the gas into a sales line for delivery into a gas gathering system for sale or recompression. The liquids output from the separator are divided into a liquid storage reservoir for subsequent disposal or sale depending upon the type of liquid produced by the reservoir.

The computer 25 is connected to receive information from pressure transducer 36 connected in the production flow line 27 and pressure transducer 37 connected in the injection gas flow line 22. Both the computer 25 as well as a downhole valve controller 30 connected thereto are supplied by power from a source 31 which may be AC or DC depending upon the facilities available.

The gas lift well completion itself may include either single or multiple completions and is shown in FIG. 1 as a single completion comprising a plurality of conventional gas lift valves 41–43 connected at spaced intervals along the tubing 16 and a conventional packer 44 located just above the perforations 15. A remote control gas lift valve 45, constructed in accordance with various embodiments of the invention, is connected into the tubing 16 just above a pressure transducer 46. Both the remote control gas lift valve 45 and the pressure transducer 46 are connected via a control line 47 to the controller 30 located at the surface. The control line 47 may be electric or pressurized or a combination of both. If it is electric, it may be a two conductor, polymer insulated cable protected with a small diameter stainless steel tubing outer shell. The control line 47 supplies both power and operating signals to control the operation of the gas lift valve 45 through the controller 30 as well as provide information related to the operation of the gas lift valve and information from the pressure transducer 46 to the controller 30.

Figure 2:
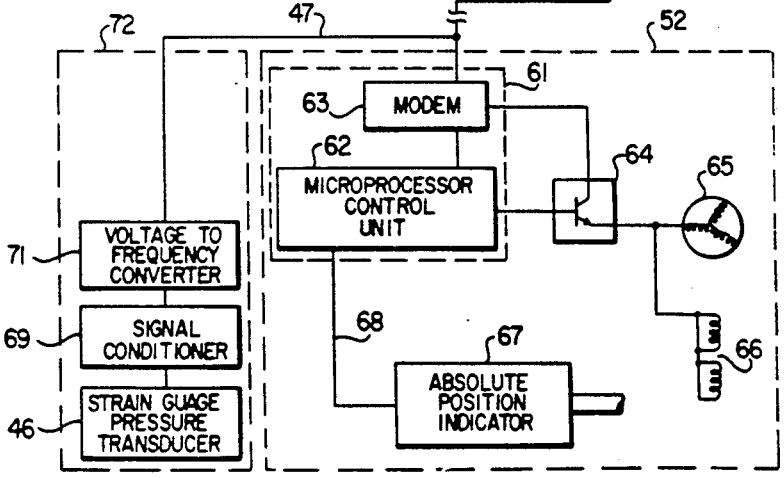
FIG. 2 is a bock diagram of the electrical components of the valve system of one aspect of the present invention.

Referring next to FIG. 2, there is shown a block diagram of the electrical components of the valve system of one aspect of the present invention. The system includes the surface electronic package including the computer 25 and the controller 30 connected to a pair of downhole electronic packages 52 and 72 by means of the control line 47. The controller 30 includes a microprocessor control unit 50 which includes means to receive input from an operator, such as a keyboard 53, and to display various operational parameters at a visual display 54. The microprocessor control unit 50 both sends information downhole and receives information from downhole via a digital communication bus 55 connected to a modem 56 coupled to the control line 47 through a filter 57. Power is supplied to the surface electronic components by means of a power supply 58. Communications to the microprocessor control unit 50 via the modem 56 and filter 57 may be either analog or digital and, if digital, can consist of an interface employing the RS-232 serial communications protocol conventional in the industry. The data separation, modulation and transmission techniques taught in U.S. Pat. No. 4,568,933, hereby incorporated by reference, may be used in the downhole communication portion of the present system.

The downhole electronics package 52 may include a telemetry sub 61 comprising a microprocessor control unit 62 and a communications modem 63 coupled to the control line 47 for two-way communications therewith. The telemetry sub 61 is connected to a motor drive circuit 64 which controls current to either a rotary motor actuation system 65 or a linear motion actuation system controlled by a solenoid 66. As will be further described below, the electric flow control valve employed in the present invention may be provided in several different embodiments including different means of valve actuation by means of either linear or rotary drives.

The orifice size of the valve may be selectively controlled from the surface in different ways. In one embodiment a control register or potentiometer in the surface electronics package 30 may be set to a selected value representing a known condition of the orifice and then incremented or decremented as signals are sent downhole to increase or decrease the size of the orifice. In other embodiments, the flow control valve may include an absolute position indicator 67 which provides a signal indicating the absolute position of the valve orifice, through an indicator line 68, to the microprocessor 62 for communication of that information uphole to the surface control unit 30. The subsurface electronics package 72 may include a downhole pressure transducer 46 which may take the form of a strain gauge pressure transducer, connected through a signal conditioner 69, such as an over voltage protection and a voltage to frequency converter 71, for communication of the pressure information uphole to the surface electronic control package 30 through the control line 47. In addition, other parameter measurement means such as a downhole flow rate indicator (not shown) may also be provided in the subsurface electronics package 52.

The surface electronic control unit 30 monitors downhole pressure information from the strain gauge pressure transducer 46 as well as information from the position indicator 67 indicating the current position of the flow control orifice of the flow control valve. Valve orifice size is monitored by the absolute position indicator 67 through the microprocessor control unit 62 and the modem 63 which sends the encoded data via control line 47 to the surface. In addition, the surface control electronics package 30 also sends power and control signals downhole via the control line 47, the modem 63 and microprocessor control unit 62 to control the application of power to the motor/solenoid drive circuit 64 for changing the size of the orifice of the flow control valve.

In general, the surface control unit 30 provides an interface between the computer 25, the transducers 46 and 67 downhole, the electrically controlled gas lift valve 45, and the operators of the system. The controller 30 operates the gas lift valve 45, supplies power to the downhole components and separates the monitoring signals from the transducers 46 and 67. Information telemetered from the downhole control equipment 52 will be displayed at the display 54 of the controller 30. In addition, the computer 25 may also monitor other well parameters, such as the pressure transducers 36 and 37, and control other well components such as motor valve 23 in order to effect a coordinated well control system related to both downhole and surface operating components.

In general, several embodiments of the downhole flow control valve are employed in conjunction with the system of the present invention. They consist of two different valve designs and two different actuator designs. Different combinations of actuators and valves may be used in particular embodiments. The two valve designs employed in the several embodiments include a non-rising stem poppet valve configuration and a rotary, lapped, shear seal valve configuration. The two actuator designs employed include a stepper motor with gear reduction and a linear solenoid with a linear to rotary motion converter, such as a wire clutch differential ratchet mechanism and indexing cam. Each of the various embodiments of the flow control valve employed in the system of the present invention are set forth below in conjunction with FIGS. 3A-3D.

Figure 3A:
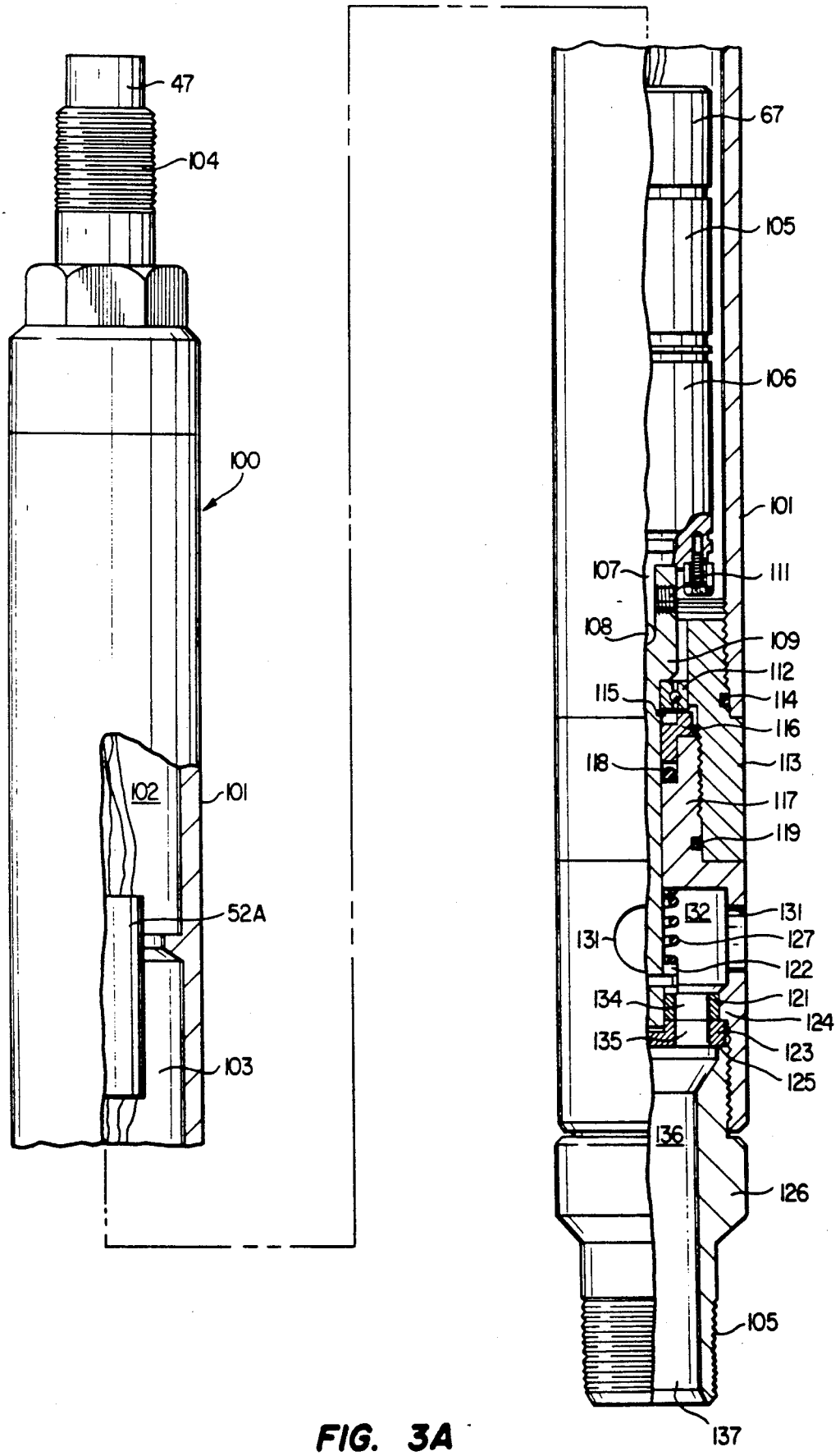
FIG. 3A is a partially cut-away and cross-sectional view of an electric flow control valve including a motor operated rotary valve.

Referring next to FIG. 3A, there is shown a partially cut-away and partially longitudinally cross-sectioned view of a flow control valve employed in one embodiment of the present invention. The valve 100 consists of an outer pressure resistant cylindrical housing 101 which includes a pair of internal chambers 102 and 103 for receiving operating components of the system. A threaded bulkhead feed through electric housing seal 104 is located in the electrical connector sub at the upper end of the valve while a threaded fluid connection 105 is located at the lower end of the valve for engagement with a coupling providing fluid communication between the valve and the interior of the well tubing. The couplings shown are for mounting on lugs welded on the outside of pup joints, i.e., conventional type gas lift mandrels. However, the mounting components of the valve could be modified for use with side pocket mandrels.

The control line 47 from the surface electronics is connected to a portion of the downhole electronics package 52A to receive control signals and deliver position information signals to the surface electronic package 30. The downhole electronics package 52A is in turn connected to an absolute position indicator 67 which may take the form of a multi-turn potentiometer as well be further discussed below. The position indicator 67 is connected to the shaft of an electric motor such as a stepper motor 105, which is in turn connected to a speed reduction gear box 106. The position indicator 67 may also include a reduction gear with a ratio identical to that of gear box 106. The motor 105 may also be a fluid powered motor in other embodiments including a fluid power driving system. The stepper motor 105 is controlled by the subsurface electronics package 52A which translates the signals from the surface controller 30, through the two conductor cables of control line 47, to the four or five wires controlling the rotation of the motor 105. The motor 105 is controlled by powering selected pairs of the four/five wires in a specific sequence. Since there is an inherent detente braking torque in a permanent magnet stepper motor, the rotation of the valve control shaft will be position stable with the motor power off.

The output drive shaft from 107 from the speed reduction gear box 106 is connected to a receiving socket 108 formed in the upper end of a rotary drive shaft 109 and held in rigid fixed driving relationship therewith by means of a socket head set screw 111. The upper end of the rotary drive shaft 109 is journaled by a low-friction ball bearing 112 which is mounted within a bearing housing 113 and resists any axial thrust of the shaft 109. The upper end of the bearing housing 113 threadedly engages the lower end of the outer housing 101 and is sealed thereto by means of an O-ring 114. The ball bearing 112 is held in position by means of a retainer ring 115 which overlies a bushing 116 received into the upper open end of a port sub 117 which threadedly engages the lower end of the bearing housing 113. An O-ring 118 forms a seal between the lower edge of the bushing 116 and the rotary shaft 109. Another O-ring 119 seals the port sub 117 to the lower edge of the bearing housing 113. The actuation components are preferably contained in a one atmosphere chamber which is sealed by means of the several static seals and the moving seal.

The lower end of the rotary drive shaft 109 is connected to a rotary valve plate 121 by means of a spiral pin 122. As the rotary valve 121 is rotated by turning of the rotary shaft 109, it moves upon the upper surface of a stationary valve plate 123. The stationary valve plate 123 is clamped into the lower end of the port sub 117 against a radially extending shoulder 124 by means of the upper edge 125 of a bottom sub 126 which threadedly engages the lower end of the port sub 117. A helical valve spring 127 serves to exert a downward force against the upper surface of the rotary valve plate 121 to hold its lower surface in tight shear-seal engaging relationship with the upper surface of the stationary valve plate 123 to minimize leakage therebetween. The sealing action between plates 121 and 123 is a lapped wiping-type seal similar to a floating seat type of gate valve. A plurality of orthogonally located flow intake ports 131 provide openings to allow the flow of fluids from outside of the valve 100 into the generally cylindrical chamber 132 formed within the port sub 117. Fluid flows from chamber 132 and through the apertures 134 in the rotary valve plate 121 and the corresponding apertures 135 in the stationary valve plate 123 to the extent that they are axially aligned with one another. From the valve plates 121 and 123 flow moves along an axial passageway 136 through the bottom sub 126 and out the lower end 137 of the flow control valve 100.

As will be further discussed below, the shape and size of the flow ports 134 and 135 affects the size of the effective flow orifice of the valve as well as the relationship of orifice size versus the relative angle of rotation of the valve plates. The valve plate will rotate between 60 and 180 degrees ingoing from full closed to full open depending upon the number of flow ports between 1 and 3 in the valve plates.

As can be seen, rotation of the stepper motor 105 turns the output shaft 107 of the gear reducer 106 to rotate the rotary shaft 109 and thereby turn the rotary valve 121 which is connected to the lower end of the shaft. The degree to which flow ports 134 in the rotary valve plate 121 and flow ports 135 in the stationary valve plate 123 are aligned with one another determines the degree to which fluids entering the valve 100 through the flow intake ports 131 can pass through the ports 134 and 135, along the passageway 136 and out the lower end 137 of the flow control valve. The rotation of the motor 105 also turns the rotary shaft position indicator 167 which provides rotary position indication signals through the electronics 52A and the control line 47 to the surface electronics package 30 indicating the actual rotational position of the motor 105 and hence the correlated size of the effective flow orifice in the valve plates 121 and 123. As can also be seen, deenergizing the stepper motor 105 causes the flow openings through the valve plates 121 and 123 to remain position stable, i.e., they hold their orifice positions and the size of effective orifice flow which is allowed through them until further rotation of the stepper motor 105 changes the orifice size.

Figure 3B:
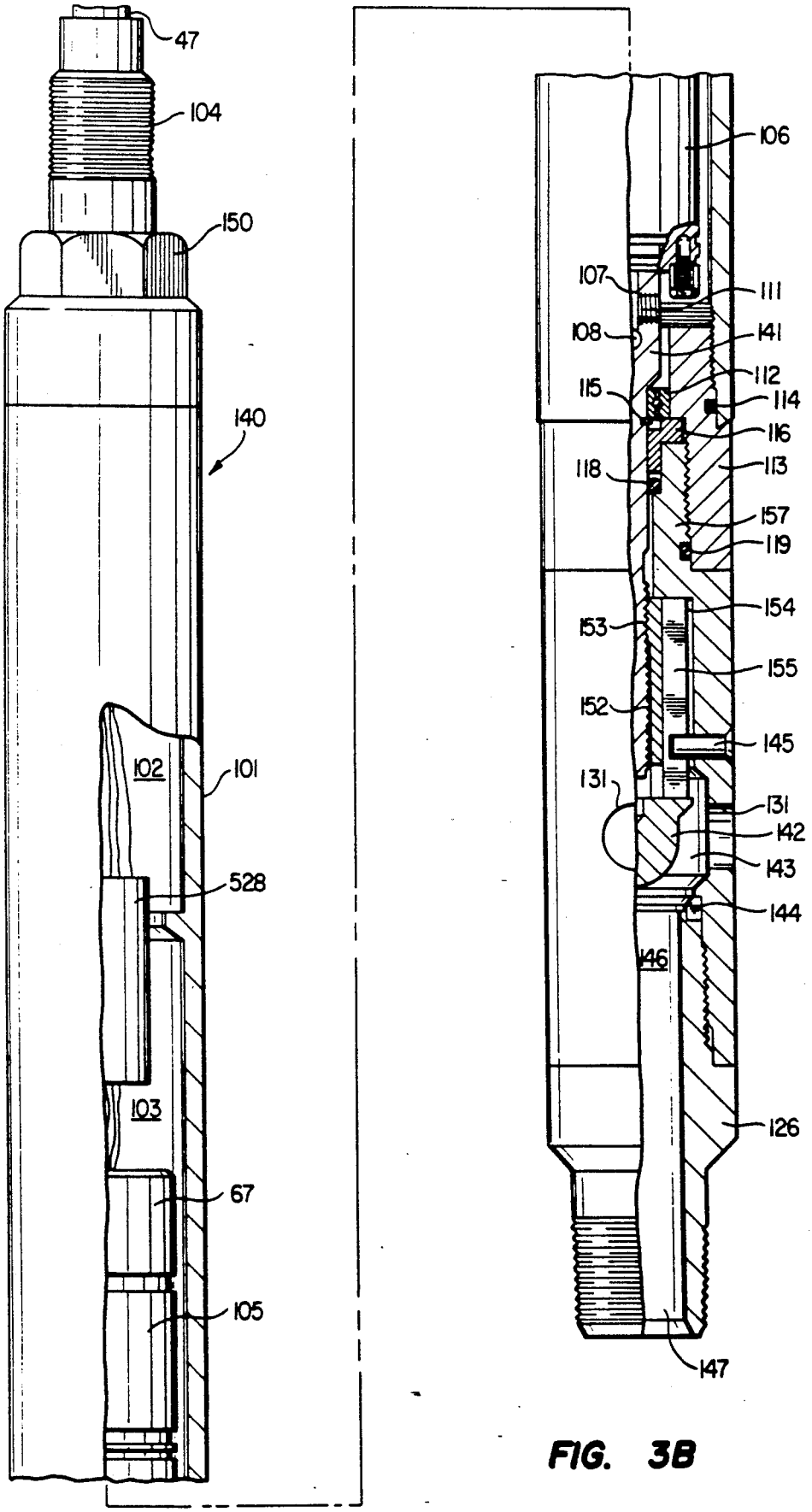
FIG. 3B is a partially cut-away and cross-sectioned view of an electric flow control valve including a motor operated poppet valve.

Referring next to FIG. 3B, there is shown a second embodiment of a flow control valve employed in the system of the present invention which also employs a motor as a driving means but includes a non-rising stem poppet valve, rather than a rotary valve, as the actual flow control mechanism. As shown in FIG. 3B, the flow control valve 140 includes an outer housing 101 having a threaded coupling 104 at the upper end into which is received the control line 47. The line 47 enters through a bulkhead feed through electrical housing seal into the electrical connector sub 150. Within the housing 101 is contained a pair of instrument cavities 102 and 103 which houses part of the downhole electronic sub 52B. The downhole control electronics 52B are connected to a rotary absolute position indicator 67 which is connected to a stepper motor 105. The shaft of the motor 105 is connected to the shaft of the position indicator 67, such as a multi-turn potentiometer so that the indicator always produces a direct indication of the rotary position of the motor 105 which telemetered to the surface electronics 30 through the downhole electronics 52B and the control line 47. The output shaft of the stepper motor 105 is connected to a speed reduction gear box 106, the output shaft of which 107 is coupled to a socket 108 located in the upper end of a rotary drive shaft 141. The speed reducer shaft 107 is coupled to the rotary drive shaft 141 by means of a socket head set screw 111. The rotary drive shaft 141 is journaled and prevented from axial movement by means of a low friction ball bearing 112 which is received into a bearing housing 113. The upper end of the bearing housing 113 is threadedly engaged with the lower end of the housing 101 and sealed thereto by means of an O-ring 114. The ball bearing 112 is held in place by means of a retainer ring 115 and a bushing 116 which is received into the upper end of a port sub 151. The upper end of the port sub 151 is threadedly engaged into the lower end of the bearing housing 113 and sealed thereto by means of an O-ring 119. The rotary shaft 141 is sealed by means of an O-ring 118 and extends axially down through the port sub 151. The shaft 141 includes external threads 152 formed on the lower end thereof which are in threaded engagement with the internal threads of a drive insert 153 axially positioned within and affixed to a non-rising poppet valve shaft 154. The lower end of the poppet valve 154 has a poppet head 142 affixed thereto. A key slot 155 extends in the axial direction along the periphery of the valve shaft 154 and engages a pin 145 passing through the sidewall of the port sub 151. The pin 145 and slot 155 prevent the poppet valve shaft 154 from rotating within the port sub 151.

The lower end of the port sub 151 threadedly engages the upper end of a bottom sub 126, the upper edges of which mount a poppet valve seat 144. The circular edge of the seat 144 is configured to receive the outer peripheral surface of the poppet head 142 attached to the lower end of the poppet valve shaft 154 to form a seal therebetween. The valve nose of the poppet head 142 is shaped to provide a selected linear movement versus flow area relationship through the valve operating range. The lower edge of the port sub 151 contains a plurality of orthogonally located flow intake ports 131 formed through the outer wall of the valve housing and which are connected to a generally cylindrical cavity 143 in flow communication with an axial passageway 146 leading to the outlet end of the valve 147. When the poppet valve head 142 is spaced from the poppet valve seat 144, flow of fluid can occur from the outside of the valve through the flow intake port 131, the annular cavity 143, the flow passageway 146 and out the lower end 147 of the valve. Rotation of the rotary drive shaft 141 in one direction causes the threaded engagement between the lower end 152 of the shaft 141 and the internal drive threads 153 of the poppet valve shaft 154 to rotate with respect to one another. This relative rotation moves the valve shaft 154 downwardly to cause the poppet valve head 142 to come closer to the valve seat 144 restricting the flow of fluids therebetween. Continued movement of the poppet valve head 142 downwardly results in it engaging the circular edges of the seat 144 to form a seal therebetween and stop all flow between the flow intake port 131 and the valve outlet 147. Similarly, rotation of the rotary drive shaft 141 in the opposite direction moves the poppet valve head 142 in the upward direction to open the flow orifice of the valve. Positioning the poppet valve head 142 in an intermediate position with respect to the valve seat 144 causes a restriction in the flow in proportion to the distance between the valve head 142 and the valve seat 144. Thus, the rotational position of the drive shaft 141 is directly related to the flow control orifice between the poppet head 142 and the valve seal 144.

In the operation of the poppet valve mechanics of FIG. 3B there is no displacement of the poppet valve or stem into or out of the actuation chamber. This reduces the operating forces for the valve to those of: (a) the friction of one shaft seal; (b) the friction of the threads and the key pin and slot; (c) the forces to seal and unseal the valve; and (d) the flow friction forces. The poppet valve is position stable with no inherent tendency of the valve orifice to change positions without powered rotation of the stepper motor 105. In the fully closed position, the valve seats for a low leak condition. If desired the valve can also be provided with a resilient seat for improved sealing.

As can be seen, the production of electrical signals by the surface controller on the control line 47 causes the production of control signals from the downhole electronics 52B to cause rotation of the stepper motor 105, rotation of the speed gear reducer 146 and thus the rotary shaft 147. Rotation of the shaft 147 causes a change in the flow control orifice between the exterior of the valve 140 and the lower end 147 thereof. The rotational position indicator 67 is connected to the shaft of the stepper motor 105 through a reduction gear and hence its output always indicates a value which can be directly correlated to the degree of flow being allowed through the flow control valve. As can also be seen, the interruption of all current flow to the stepper motor 105 results in the relative positions between the poppet valve head 142 and the poppet valve seat 144 remaining the same. Hence the valve orifice remains in a position stale configuration until the application of additional current to the stepper motor 105 to change the flow control positions of the relative parts of the valve.

Figure 3C:
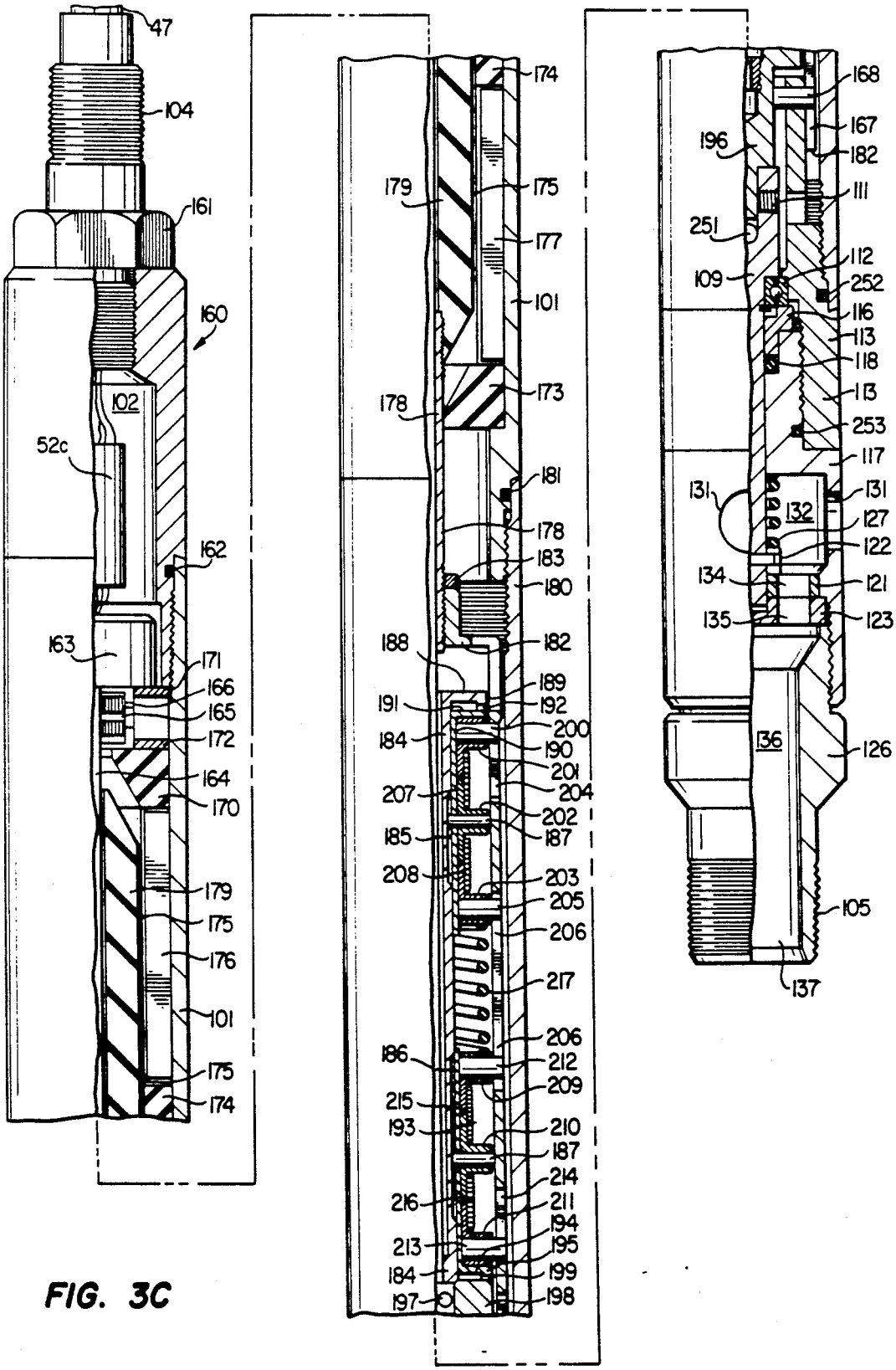
FIG. 3C is a partially cut-away and cross-sectioned view of an electric flow control valve including a solenoid operated rotary valve.

Referring next to FIG. 3C, there is shown a third embodiment of a flow control valve employed in the system of the present invention which employs rotary flow control valve plates, as in the case of the first valve embodiment, but which uses a axially moving solenoid armature to provide the actuation means for rotating the valve. This is accomplished by means of a linear to rotary translation conversion mechanism within the valve body which converts the linear movements of the solenoid armature into rotary movements of the valve.

As shown in FIG. 3C, the valve 160 includes a bulkhead feed through electric housing seal to allow passage of the control line 47 into an electrical connector sub 161. The electrical connector sub 161 mounts a downhole electronics package 52C in a cavity 102 which contains the downhole electronics necessary for applying the control actuation pulses sent via the control line 47 to operate the valve. The downhole electronics 52C also sends signals from a position indicator located within the valve 160 to the surface via the control line 47 to indicate at the surface controller 30 the current position of the valve. The electrical connector sub 160 is connected to the valve housing 101 and sealed thereto by means of an O-ring 162. Within the housing 101 is a valve position indicator 163 which is connected to an indicator shaft 164. The indicator shaft 164 is connected to the indicator 163 by means of an indicator coupler 165 held in place through a set screw 166. The indicator 163 is spaced from an upper magnetic end piece 170 by means of a pair of spacers 171 and 172. Spaced between the upper magnetic end piece 170 and a lower magnetic end piece 173 is a magnetic centerpiece 174. A coil spool 175 has wound thereon an upper coil 176 and positioned between the upper end piece 170 and the magnetic centerpiece 174 and a lower coil 177 positioned between the lower magnetic end piece 173 and the magnetic centerpiece 174. A moveable solenoid armature comprises an axially moveable core nipple 178 which is attached to the lower end of a magnetic core 179.

The solenoid housing 101 is threadedly attached to an outer ratchet housing 180 and sealed thereto by means of an O-ring 181. The lower end of the core nipple 178 is threadedly attached to the upper end of a cam sleeve 182 and held against movement by means of a clamp nut 183. The indicator rod 164 extends axially down through the core nipple 178 and is affixed to a stem extension 184. The stem extension 184 includes a pair of axially spaced, circumferentially extending recesses 185 and 186 which receive and allow axial movement of a pair of dowel pins 187.

The upper end of the stem extension 184 has a circular radially extending flange 188 which includes a downwardly facing outer edge portion 189 with radially extending teeth formed thereon. An upper clutch sleeve 190 includes an elongate tubular shaft which is journaled upon the stem extension 184 for relative movement in both circumferential directions. The upper end of the upper clutch sleeve 190 includes a circular radially extending flange 191 which has an upwardly facing outer edge portion 192 with radially extending teeth thereon. When the radial teeth in the downwardly facing edge portion 189 of the stem extension flange edge 188 engage the radial teeth in the upwardly facing edge portion 192 of the upper clutch sleeve flange 191 the two parts move together as a unit in the circumferential direction. The opposed sets of radial teeth formed in the clutch plates are preferably each formed with the angle of the teeth approximating the cam angle to prevent camming apart of the teeth during operation. When the two sets of radial teeth are spaced from one another the upper clutch sleeve 190 moves freely about the stem extension shaft in both circumferential directions.

An identical lower clutch sleeve 193 has an elongate tubular shaft which is journaled upon the lower portion of the stem extension 184 for relative movement in both circumferential directions. The lower end of the lower clutch sleeve 193 includes a circular radially extending flange 194 which has a downwardly facing outer edge portion 195 with radially extending teeth thereon. The lower end of the stem extension is threadedly coupled to the upper end of a stem 196 and held in secure engagement therewith by a set screw 197. The lower end of the cam sleeve 182 overlies most of the stem 196 and includes a longitudinal slot 167 which is open at the lower end to receive the dowel pin 168. The upper end of the stem 196 has a circular radially extending shoulder 198 which includes an upwardly facing outer edge portion 199 with radially extending teeth. When the angularly formed radial teeth of the upwardly facing edge portion 199 of the stem shoulder 198 engage the angularly formed radial teeth in the downwardly facing edge portion 195 of the lower clutch sleeve flange 194 the two parts, along with the stem extension 184, move together in the circumferential direction. When the two sets of radial teeth are spaced from one another, the lower clutch sleeves 193 moves freely about the stem extension shaft in both circumferential directions.

Overlying and journaled upon the outer surface of the tubular shaft of the upper clutch sleeve 190 are an upper end drum 201, a center drum 202 and a lower end drum 203. The upper end drum 201 includes a dowel pin 200 which is received into an upper longitudinally extending slot 204 in the cam sleeve 182. The center drum 202 includes a dowel pin 187 which extends through an aperture in the upper clutch sleeve 190 to rigidly connect it therewith and into the upper recess 185 in the stem extension 184. The lower end drum 203 includes a dowel pin 205 which is received into a central longitudinally extending slot 206 in the cam sleeve 182. A helical clutch spring with left hand windings 207 overlies and engages the cylindrical outer surfaces of both the upper end drum 201 and the upper portion of the center drum 202. A similar helical clutch spring with right hand windings 208 overlies and engages the cylindrical outer surfaces of both the lower end drum 203 and the lower portion of the center drum 202.

Overlying and journaled upon the outer surface of the tubular shaft of the lower clutch sleeve 193 are an upper end drum 209, a center drum 210 and a lower end drum 211. The upper end drum 109 includes a dowel pin 212 which is received into the central longitudinally extending slot 206 in the cam sleeve 182. The center drum 210 includes a dowel pin 187 which extends through an aperture in the lower clutch sleeve 193 to rigidly connect it therewith and into the lower recess 186 in the stem extension 184. The lower end drum 203 includes a dowel pin 213 which is received into a lower longitudinally extending slot 214 in the cam sleeve 182. A helical clutch spring with left hand windings 215 overlies and engages the cylindrical outer surfaces of both the upper end drum 209 and the upper portion of the center drum 210. A similar helical clutch spring with a right hand winding 216 overlies and engages the cylindrical outer surfaces of the lower end drum 211 and the lower portion of the center drum 210.

A helical coil spring 217 is compressed between the radially extending flanged end of the lower end drum 203 and the radially extending flanged end of the upper end drum 209. The biasing force of spring 217 holds the dowel pin 200 in the upper end of slot 204 and the teeth on the upper surface of the outer edge portion 192 of upper clutch sleeve 190 in driving engagement with the teeth on the lower surface of the outer edge portion 189 of stem extension 184. Similarly, the biasing force of spring 217 holds the dowel pin 213 in the lower end of slot 214 and the teeth in the lower surface of the outer edge portion 195 of the lower clutch sleeve 193 in driving engagement with the teeth on the upper surface of the outer edge portion 199 of the stem 196. Downward movement of dowel pin 200 will disengage the upper sets of teeth on edge portions 192 and 189 while leaving the lower sets of teeth on edge portions 195 and 199 in driving engagement with one another. Similarly, upward movement of dowel pin 213 will disengage the lower sets of teeth on edge portions 195 and 199 while leaving the upper sets of teeth on edge portions 192 and 189 in driving engagement with one another.

Figure 7:
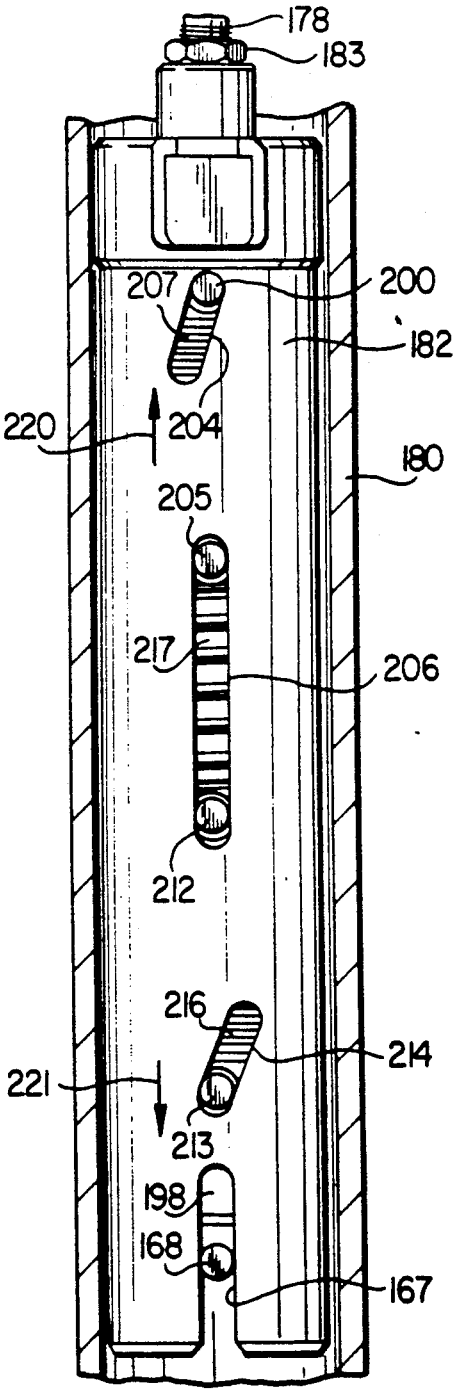
FIG. 7 is a cross-section view of a cam sleeve mechanism used in the clutch system embodiment of the present valve.

Referring briefly to FIG. 7, there can be seen how the cam sleeve 182 overlies and encloses the spring and clutch mechanisms described above. The upper slot 204 in the cam sleeve 182 which receives the dowel pin 200 is angled downwardly and to the left while the lower slot 214 in the cam sleeve 182 which receives dowel pin 213 is angled upwardly and to the right. The central slot 206 in the cam sleeve 182 which receives dowel pins 205 and 212 extends parallel to the longitudinal axis of the sleeve 182. Alternatively, the stroke length of the cam sleeve 182 may be adjusted by screwing the core nipple 178 into and out of the threads in the top of the cam sleeve. Changing the stroke length of the cam sleeve 182 in one direction over the other changes the relative distance of angular relation in one direction over the other direction on each stroke. Either of these two alternative features enable selection of the size of the valve flow orifice in very small increments of value as will be further explained below.

The lower end of the stem 196 is rigidly affixed into a socket 251 in the upper end of a rotary drive shaft 109 by means of a socket head screw 111. The upper end of the drive shaft 109 is journaled by means of a ball bearing 112 held in position by a retainer ring 115 and overlying a bushing 116. The ratchet housing 180 is threadedly attached to a bearing housing 113 and sealed thereto by means of an O-ring 252. The bearing housing 113 is, in turn, sealed to a rotary port sub 117 by means of an O-ring 253. The lower end of the drive shaft 109 is sealed by an O-ring 118 and connected to a rotary valve plate 121 by means of a spiral pin 122. The rotary valve plate 121 overlies a stationary valve plate 123. A valve spring 127 holds the rotary valve plate 121 in flush shear sealing engagement with the stationary valve plate 123. A plurality of orthogonally arranged flow intake ports 131 form a passageway between the exterior of the valve and an interior cavity 132. A plurality of flow ports 134 formed through the rotary valve plate 121 may be aligned with a matching plurality of flow ports 135 in the stationary valve plate 123 to control the flow of fluids from the exterior of the valve through the flow intake port 131, into the valve cavity 132, through the aligned ports 134 and 135 along an axially flow passage 126 and out the lower end of the valve 137. The bottom sub 126 is coupled to the lower end of the port sub 127 by means of threaded engagement. Thread 105 on the exterior of the bottom sub 126 enables coupling of the valve into other components.

This embodiment of the flow control valve has a linear solenoid driving an indexing cam sleeve which rotates a shaft through a wire clutch differential ratchet mechanism. By selecting the polarity of an applied electrical pulse at the surface, the solenoid can be selectively energized to either push or pull on the cam sleeve 182 to index the differential ratchet a portion of a revolution and a spring returns the sleeve to the center position. When no power is applied to the solenoid the valve actuator is prevented from turning so that the valve orifice is position stable in the unpowered condition.

As can be seen from FIGS. 3C and 7, energization of the coil 176 with an electrical pulse pulls the magnetic core 179 upwardly from a center position toward the upper magnetic end piece 170 while energization of the coil 177 with an electrical pulse pulls the core 179 toward the lower magnetic end piece 173. The particular coil 176 or 177 is selected for energization, by a pair of reverse connected diodes, in response to a pulse of on polarity or the other. Spring 217 keeps the core 179 in approximately the center position. Movement of the magnetic core 179 causes movement of the core nipple 178 in the axial direction moving the cam sleeve 182 in the same axial direction.

Movement of the cam sleeve 182 upwardly, in the direction of arrow 220, causes the dowel pin 200 to follow the slot 204 and move circumferentially in the clockwise direction, looking down. Such movement of the cam sleeve 182 moves the dowel pin 213 upwardly which lifts dowel pin 187 and the lower clutch sleeve 193 to disengage the lower sets of teeth on edge portions 195 and 199 to allow stem extension 184 to rotate with respect to the lower clutch sleeve 193. Upward movement of the cam sleeve 182 also moves the dowel pin 212 upwardly to maintain the compression on the spring 217 which holds the upper sets of teeth on edge portions 189 and 192 in driving engagement with one another. Circumferential movement of the dowel pin 200 in the clockwise direction the incremental distance by which the upper and lower ends of slot 204 are circumferentially displaced from one another, also rotates the upper end drum 201 through the same incremental distance. Rotation of the upper end drum 201 causes the left hand wound spring 207 to grip the center drum 202 and rotate it which moves dowel pin 187 and the upper clutch sleeve 190. The right hand wound spring 208 slips to prevent rotation of the center drum 202 from rotating the lower end drum 203. The driving engagement between the teeth on edge portion 192 of upper clutch sleeve 190 and edge portion 189 of the stem extension 184 produces an incremental rotation of the stem extension 184 and the stem 196 to which it is coupled. Rotation of the stem 196 rotates the drive shaft 109 and the upper valve plate 121 and changes the effective flow orifice of the valve an incremental amount. Return downward movement of the cam sleeve 182 to its neutral position, shown in FIG. 7, is produced by the bias of spring 217 and causes downward movement of the dowel pin 213 which reconnects the driving engagement between the lower clutch sleeve 194 and the stem 196. Return downward movement of cam sleeve 182 also causes dowel pin 200 to follow the upper slot 204 and move circumferentially an incremental distance in the counter clockwise direction, looking down. Such movement of pin 200 rotates the upper end drum 201 but, because of slippage of the left hand spring 207, the center drum 202 does not rotate and the upper clutch sleeve 190 does not rotate so that the stem extension 184, the stem 196, the rotary shaft 109 and the upper valve plate 121 remain where they were and the flow control orifice is not changed.

Similarly, movement of the cam sleeve downwardly, in the direction of arrow 221, causes the dowel pin 213 to follow the slot 214 and move circumferentially in the counter-clockwise direction, looking down. Such movement of the cam sleeve 182 moves the dowel pin 200 downwardly which pulls dowel pin 187 and the upper clutch sleeve 190 downwardly to disengage the upper sets of teeth on edge portions 189 and 192 to allow stem extension 184 to rotate with respect to the upper clutch sleeve 191. Downward movement of the cam sleeve 182 also moves the dowel pin 205 downwardly to maintain the compression on the spring 217 which holds the lower set of teeth on edge portions 195 and 199 in driving engagement with one another. Circumferential movement of the dowel pin 213 in the counter-clockwise direction incremental distance by which the upper and lower ends of slot 214 are circumferentially displaced from one another, also rotates the lower end drum 211 through the same incremental distance. Rotation of the lower end drum 211 causes the right hand wound spring 216 to grip the center drum 210 and rotate it which moves dowel pin 187 and lower clutch sleeve 194. The driving engagement between the teeth on edge portions 195 on lower clutch sleeves 194 and edge portion 199 of the stem 196 produces an incremental rotation of the stem 196. Rotation of the stem 196 rotates the drive shaft 109 and the upper valve plate 121 and changes the effective flow orifice of the valve an incremental amount.

Return upward movement of the cam sleeve 182 to its neutral position, shown in FIG. 7, is produced by the bias of spring 217 and causes upward movement of dowel pin 200 to reconnect the driving engagement between the upper clutch sleeve 191 and the stem extension 184. Return upward movement of cam sleeve 182 also causes dowel pin 213 to follow the lower slot 214 and move circumferentially an incremental distance in the clockwise direction, looking down. Such movement of pin 213 rotates the lower end drum 211 but, because of slippage of the right hand spring 215 the center drum 210 does not rotate and the lower clutch sleeve 194 does not rotate so that the stem 196, the rotary shaft 109 and the upper valve plate 121 remain where they were and the flow control orifice is not changed.

It should be noted that the incremental distance in the circumferential direction by which the stem 196 moves in the counter-clockwise direction, looking down, in response to an upward movement of the cam sleeve 182 will be slightly greater than the incremental distance in the circumferential direction by which the stem 196 moves in the clockwise direction in response to a downward movement of the cam sleeve. This is because of the slight difference in slant angle between slots 204 and 214 from the axis of the cam sleeve 192. Alternatively, as mentioned, the stroke distance of cam sleeve 182 may be adjusted to produce a comparable result. This angular difference enables effective incremental movements of the rotary drive shaft 109 which are as small as the difference between the two circumferential movements in the opposite directions. Selective adjustment is accomplished by one or more movements in one direction followed by a selected number of movements in the opposite direction. The effective movement of the drive shaft is the difference between sum of the incremental movements in each direction.

As can be seen from the above description, each axial movement of the magnetic core 179 in the upward direction produces rotational movement of the rotary valve plate 121 in one direction while each axial movement of the core 179 in the downward direction causes rotational movement of the rotary valve plate 121 in the opposite direction. The rotational movement of the rotary valve plate 121, with respect to the stationary valve plate 123, occurs in a series of individual increments which are a function of the number and direction of the axial movements in the core 179. Thus, pulsing the solenoid windings of the core 179 causes it to perform one or more successive movements from its center position to either an upward or downward position, depending upon the polarity of the pulse, and then return to the center position. These movements cause successive rotational movements in the rotary valve plate 121. When the core 179 is stationary, the rotary valve plate 121 is also stationary and position stable with respect to its given position. Rotational movement of the rotary drive shaft 109 similarly rotates the indicator shaft 164 to rotate the shaft of the indicator 163 and thus provide an uphole indication, through the downhole electronics 52C and the control line 47, of the position of the rotary valve plate 121, and, hence, the effective valve orifice size. Alternatively, a register can be used to maintain a count of the number and polarity of the pulses applied to the solenoid and thereby maintain a continuous indication of the effective valve orifice size from a calibrated reference value.

As can be seen, the solenoid actuating mechanism initially takes movement in the axial direction and translates that into rotational movement by virtue of the linear to rotational movement translation portion of the third embodiment of the flow control valve shown in FIG. 3C.

Figure 3D:
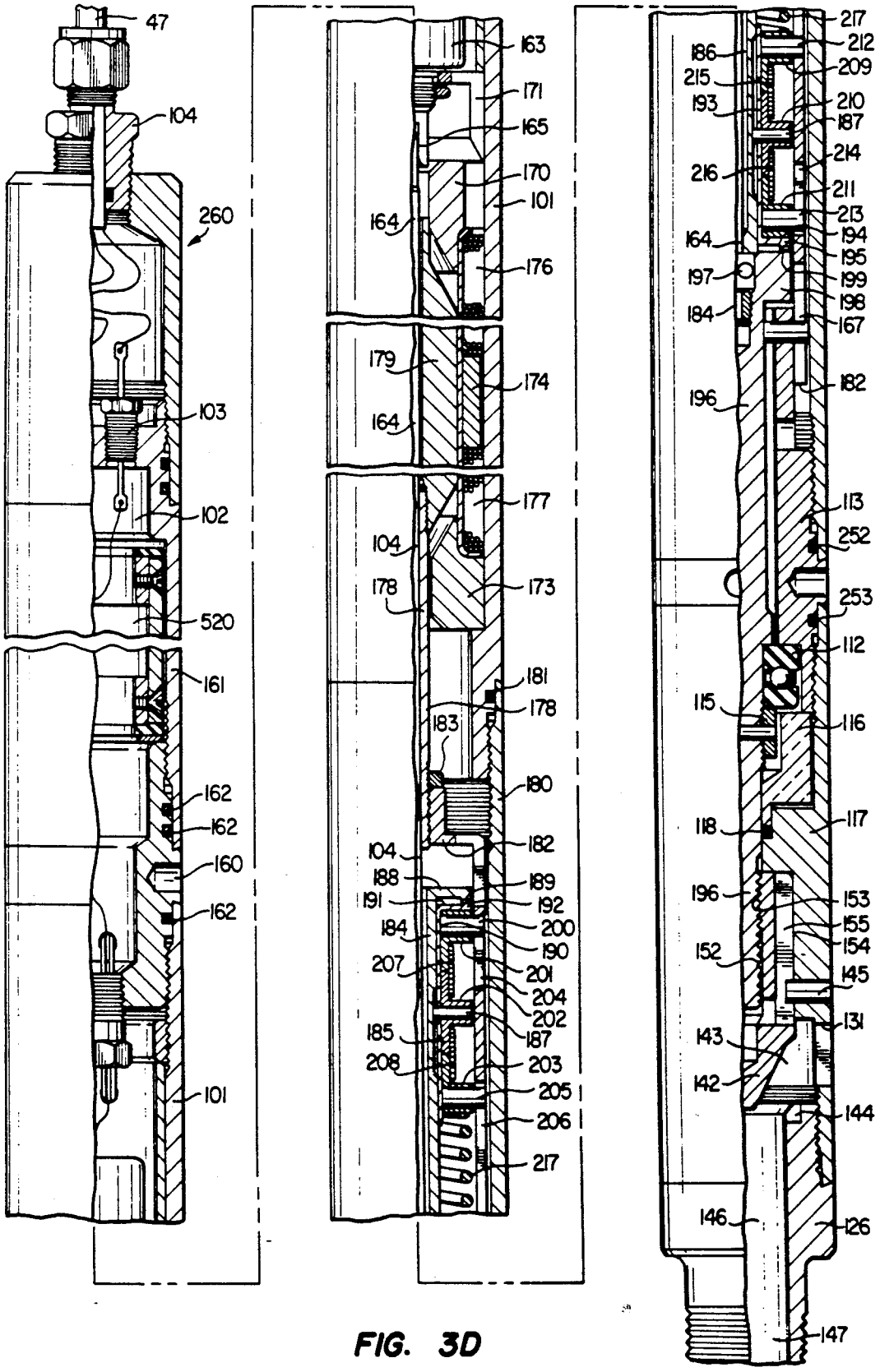
FIG. 3D is a partially cut-away and cross-sectioned view of an electric flow control valve including a solenoid operated poppet valve.

Referring next to FIG. 3D, there is shown a poppet flow control valve which incorporates the solenoid actuated rotating mechanism, incorporated in the third embodiment of FIG. 3C, with a poppet type valve closure structure to produce a fourth embodiment of the flow control valve of the present invention. As shown therein, a valve 260 includes a bulkhead feed through electric housing seal 104 connecting with a top housing which receives and seals the control line 47 against well bore fluids. The electrical leads are connected through second feed through sealing connectors 103 into chamber 102 which houses the downhole electronics package 52D. The electronic connector sub 161 is coupled through a bulkhead sub 160 to a coil housing sub 101 by means of threaded interconnections and seals comprising O-rings 162. A position indicator 163 includes an indicator rod 164 coupled to the shaft thereof for rotational movement. A valve position indicator 163 is coupled to an indicator rod 164 by means of a shaft coupler 165 and mounted by means of a potentiometer bulkhead 171. An upper magnetic end piece 170 and a lower magnetic end piece 173 are separated by means of a magnetic centerpiece 174. A coil spool 175 extends between the upper and lower magnetic end pieces 170 and 173 and has an upper coil 176 located between the upper magnetic end piece and the magnetic centerpiece 174 and a lower coil 177 located between the lower magnetic end piece and the 173 and the magnetic centerpiece 174. A magnetic core 179 is mounted for axial movement in response to the direction of flow of current through the upper coil 176 and the lower coil 177.

The lower end of the magnetic core 179 is threadedly attached to the upper end of a core nipple 178 the lower end of which is threadedly mounted to the upper end of a cam sleeve 182 and clamped thereto by means of a nut 183. The indicator rod 164 extends axially down through the core nipple 178 and is affixed to a stem extension 184. The stem extension 184 includes a pair of axially spaced, circumferentially extending recesses 185 and 186 which receive and allow movement of a pair of dowel pins 187.

The upper end of the stem extension 184 has a circular radially extending flange 188 which includes a downwardly facing outer edge portion 189 with radially extending teeth formed thereon. An upper clutch sleeve 190 includes an elongate tubular shaft which is journaled upon the stem extension 184 for relative movement in both circumferential directions. The upper end of the upper clutch sleeve 190 includes a circular radially extending flange 191 which has an upwardly facing outer edge portion 192 with radially extending teeth thereon. When the radial teeth in the downwardly facing edge portion 189 of the stem extension flange edge 188 engage the radial teeth in the upwardly facing edge portion 192 of the upper clutch sleeve flange 191 the two parts move together as a unit in the circumferential direction. The teeth on the face of the opposed clutch plates are preferably angled as described above. When the two sets of radial teeth are spaced from one another the upper clutch sleeve 190 moves freely about the stem extension shaft in both circumferential directions.

An identical lower clutch sleeve 193 has an elongate tubular shaft which is journaled upon the lower portion of the stem extension 184 for relative movement in both circumferential directions. The lower end of the lower clutch sleeve 193 includes a circular radially extending flange 194 which has a downwardly facing outer edge portion 195 with radially extending teeth thereon. The lower end of the stem extension is threadedly coupled to the upper end of a stem 196 and held in secure engagement therewith by a set screw 197. The lower end of the cam sleeve 182 overlies most of the stem 196 and includes a longitudinal slot 167 which is open at the lower end to receive the dowel pin 168. The upper end of the stem 196 has a circular radially extending shoulder 198 which includes an upwardly facing outer edge portion 199 with radially extending teeth. When the angled radial teeth of the upwardly facing edge portion 199 of the stem shoulder 198 engage the angled radial teeth in the downwardly facing edge portion 195 of the lower clutch sleeve flange 194 the two parts, along with the stem extension 184, move together in the circumferential direction. When the two sets of radial teeth are spaced from one another, the lower clutch sleeves 193 moves freely about the stem extension shaft in both circumferential directions.

Overlying and journaled upon the outer surface of the tubular shaft of the upper clutch sleeve 190 are an upper end drum 201, a center drum 202 and a lower end drum 203. The upper end drum 201 includes a dowel pin 200 which is received into an upper longitudinally extending slot 204 in the cam sleeve 182. The center drum 202 includes a dowel pin 187 which extends through an aperture in the upper clutch sleeve 190 to rigidly connect it therewith and into the upper recess 185 in the stem extension 184. The lower end drum 203 includes a dowel pin 205 which is received into a central longitudinally extending slot 206 in the cam sleeve 182. A helical clutch spring with left hand windings 207 overlies and engages the cylindrical outer surfaces of both the upper end drum 201 and the upper portion of the center drum 202. A similar helical clutch spring with right hand windings 208 overlies and engages the cylindrical outer surfaces of both the lower end drum 203 and the lower portion of the center drum 202.

Overlying and journaled upon the outer surface of the tubular shaft of the lower clutch sleeve 193 are an upper end drum 209, a center drum 210 and a lower end drum 211. The upper end drum 109 includes a dowel pin 212 which is received into the central longitudinally extending slot 206 in the cam sleeve 182. The center drum 210 includes a dowel pin 187 which extends through an aperture in the lower clutch sleeve 193 to rigidly connect it therewith and into the lower recess 186 in the stem extension 184. The lower end drum 203 includes a dowel pin 213 which is received into a lower longitudinally extending slot 214 in the cam sleeve 182. A helical clutch spring with left hand windings 215 overlies and engages the cylindrical outer surfaces of both the upper end drum 209 and the upper portion of the center drum 210. A similar helical clutch spring with a right hand winding 216 overlies and engages the cylindrical outer surfaces of the lower end drum 211 and the lower portion of the center drum 210.

A helical coil spring 217 is compressed between the radially extending flanged end of the lower end drum 203 and the radially extending flanged end of the upper end drum 209. The biasing force of spring 217 holds the dowel pin 200 in the upper end of slot 204 and the teeth on the upper surface of the outer edge portion 192 of upper clutch sleeve 190 in driving engagement with the teeth on the lower surface of the outer edge portion 189 of stem extension 184. Similarly, the biasing force of spring 217 holds the dowel pin 213 in the lower end of slot 214 and the teeth in the lower surface of the outer edge portion 195 of the lower clutch sleeve 193 in driving engagement with the teeth on the upper surface of the outer edge portion 199 of the stem 196. Downward movement of dowel pin 200 will disengage the upper sets of teeth on edge portions 192 and 189 while leaving the lower sets of teeth on edge portions 195 and 199 in driving engagement with one another. Similarly, upward movement of dowel pin 213 will disengage the lower sets of teeth on edge portions 195 and 199 while leaving the upper sets of teeth on edge portions 192 and 189 in driving engagement with one another.

Referring briefly to FIG. 7, there can be seen how the cam sleeve 182 overlies and encloses the spring and clutch mechanisms described above. The upper slot 204 in the cam sleeve 182 which receives the dowel pin 200 is angled downwardly and to the left while the lower slot 214 in the cam sleeve 182 which receives dowel pin 213 is angled upwardly and to the right. The central slot 206 in the cam sleeve 182 which receives dowel pins 205 and 212 extends parallel to the longitudinal axis of the sleeve 182. As can be seen from FIG. 7, the incremental distance in the circumferential direction by which the upper and lower ends of the lower slot 214 are separated from one another is slightly greater than the incremental distance in the circumferential direction by which the upper and lower ends of the upper slot 204 are separated from one another. This feature and the alternative feature of adjusting the cam sleeve stroke length described above, enable selection of the size of the valve flow orifice in very small increments of value as will be further explained below.

Movement of the cam sleeve 182 upwardly, in the direction of arrow 220, causes the dowel pin 200 to follow the slot 204 and move circumferentially in the clockwise direction, looking down. Such movement of the cam sleeve 182 moves the dowel pin 213 upwardly which lifts dowel pin 187 and the lower clutch sleeve 193 to disengage the lower sets of teeth on edge portions 195 and 199 to allow stem extension 184 to rotate with respect to the lower clutch sleeve 193. Upward movement of the cam sleeve 182 also moves the dowel pin 212 upwardly to maintain the compression on the spring 217 which holds the upper sets of teeth on edge portions 189 and 192 in driving engagement with one another. Circumferential movement of the dowel pin 200 in the clockwise direction the incremental distance by which the upper and lower ends of slot 204 are circumferentially displaced from one another, also rotates the upper end drum 201 through the same incremental distance. Rotation of the upper end drum 201 causes the left hand wound spring 207 to grip the center drum 202 and rotate it which moves dowel pin 187 and the upper clutch sleeve 190. The right hand wound spring 208 slips to prevent rotation of the center drum 202 from rotating the lower end drum 203. The driving engagement between the teeth on edge portion 192 of upper clutch sleeve 190 and edge portion 189 of the stem extension 184 produces an incremental rotation of the stem extension 184 and the stem 196 to which it is coupled. Rotation of the stem 196 rotates the drive shaft 109 and the upper valve plate 121 and changes the effective flow orifice of the valve an incremental amount.

Return downward movement of the cam sleeve 182 to its neutral position, shown in FIG. 7, is produced by the bias of spring 217 and causes downward movement of the dowel pin 213 which reconnects the driving engagement between the lower clutch sleeve 194 and the stem 196. Return downward movement of cam sleeve 192 also causes dowel pin 200 to follow the upper slot 204 and move circumferentially an incremental distance in the counter clockwise direction, looking down. Such movement of pin 200 rotates the upper end drum 201 but, because of slippage of the left hand spring 107 the center drum 202 does not rotate and the upper clutch sleeve 190 does not rotate so that the stem extension 184, the stem 196, the rotary shaft 109 and the upper valve plate 121 remain where they and the flow control orifice is not changed.

Similarly, movement of the cam sleeve downwardly, in the direction of arrow 221, causes the dowel pin 213 to follow the slot 214 and move circumferentially in the counter-clockwise direction, looking down. Such movement of the cam sleeve 182 moves the dowel pin 200 downwardly which pulls dowel pin 187 and the upper clutch sleeve 190 downwardly to disengage the upper sets of teeth on edge portions 189 and 192 to allow stem extension 184 to rotate with respect to the upper clutch sleeve 191. Downward movement of the cam sleeve 182 also moves the dowel pin 205 downwardly to maintain the compression on the spring 217 which holds the lower set of teeth on edge portions 195 and 199 in driving engagement with one another. Circumferential movement of the dowel pin 213 in the counter-clockwise direction the incremental distance by which the upper and lower ends of slot 214 are circumferentially displaced from one another, also rotates the lower end drum 211 through the same incremental distance. Rotation of the lower end drum 211 causes the right wound spring 216 to grip the center drum 210 and rotate it which moves dowel pin 187 and lower clutch sleeve 194. The driving engagement between the teeth on edge portions 195 on lower clutch sleeves 194 and edge portion 199 of the stem 196 produces an incremental rotation of the stem 196. Rotation of the stem 196 rotates the drive shaft 109 and the upper valve plate 121 and changes the effective flow orifice of the valve an incremental amount.

Return upward movement of the cam sleeve 182 to its neutral position, shown in FIG. 7, is produced by the bias of spring 217 and causes upward movement of dowel pin 200 to reconnect the driving engagement between the upper clutch sleeve 191 and the stem extension 184. Return upward movement of cam sleeve 182 also causes dowel pin 213 to follow the lower slot 214 and move circumferentially an incremental distance in the clockwise direction, looking down. Such movement of pin 213 rotates the lower end drum 211 but, because of slippage of the right hand spring 215 the center drum 210 does not rotate and the lower clutch sleeve 194 does not rotate so that the stem 196, the rotary shaft 109 and the upper valve plate 121 remain where they were and the flow control orifice is not changed.

It should be noted that the incremental distance in the circumferential direction by which the stem 196 moves in the counter-clockwise direction, looking down, in response to an upward movement of the cam sleeve 182 will be slightly greater than the incremental distance in the circumferential direction by which the stem 196 moves in the clockwise direction in response to a downward movement of the cam sleeve. This is because of the difference in stroke length of the cam sleeve, as described above, or because of the slight difference in slant angle between slots 204 and 214 from the axis of the cam sleeve 192. This angular different enables effective incremental movements of the rotary drive shaft 109 which are as small as the difference between the two circumferential movements in the opposite directions. Selective adjustment is accomplished by one or more movements in one direction followed by a selected number of movements in the opposite direction. The effective movement of the drive shaft is the difference between sum of the incremental movements in each direction.

The ratchet housing 180 is threadedly engaged to the bearing housing 113 and sealed thereto by means of an O-ring 252. The rotary drive shaft comprising the stem 196 is journaled by means of a ball bearing 112 held in place by a retainer ring 115 and a bearing bushing 116. The bushing is held in place by means of the upper edges of a port sub 117 which threadedly engages the bearing housing 113 and is sealed thereto by means of an O-ring 253.

The lower end of the stem 196 is externally threaded at 152 and engages the internal threads of a drive thread 153 of a non-rising stem poppet valve shaft 154. A longitudinally extending slot 155 is formed along the length of the valve shaft 154 and is engaged by a spiral pin 145 extending through the wall of the rotary port sub 117 to prevent rotation of the valve shaft 154. The lower end of the valve shaft 154 has formed thereon a poppet head 142 which is located for engagement with a poppet valve seat 144. The valve seat 144 is held in place at the upper end of a bottom sub 126 which threadedly engages the lower end of the rotary port sub 117. A plurality of orthogonally located flow intake ports 131 are formed in the outer wall of the rotary port sub 117 and communicate with an internal cavity 143 within which is mounted the poppet valve head 142. The cavity 143 is in fluid communication with a longitudinally extending passageway 146 which joins the exit opening 147 at the lower end of the bottom sub 126. Rotation of the stem 196 in one direction causes the threaded drive 153 within the poppet valve shaft 154 to move the poppet head 142 downwardly toward the seat 144 and close the opening therebetween. Rotation of the stem 196 in the opposite direction causes movement of the poppet head 142 in the upward direction and, hence, opens the spacing between the valve seat 144 and the poppet head 142 to allow an additional amount of flow through the variable orifice of the valve. The poppet head 142 in this embodiment is shown to have a generally conical outer surface to produce a relatively linear relationship between change in head position and change in valve flow rate. Other outer head configurations, as shown in other embodiments, are possible for various head movement/-flow rate relationships.

As can be seen, axial movement of the solenoid core 179 in the upward direction is produced by energization of the upper coil 176 and lower coil 177 with one polarity of pulse while axial movement of the core 179 in the downward direction is produced by the flow of current through the coils 176 and 177 in the opposite direction. Axial movement of the core 179 produces axial movement of the core nipple 176 which moves the cam sleeve 182 in the vertical direction. Axial movement of the cam sleeve 182 produces rotational movement of the stem 196 as a result of camming action of the slots 204 and 214 against the dowel pins 200 and 213 as explained above. This rotational movement of the dowel pins 200 and 213 rotates the stem 196 to produce rotary movement of the threads 152. Rotation of the threads 152 moves the poppet valve shaft 154 in the axial direction to change the size of the orifice of the poppet valve. Rotational movement of the stem 196 also rotates the indicator rod 164 to change the position of the indicator 163 and indicate through the downhole electronics 152D the position of the rotational shaft and thereby correlate it with the size of the effective flow orifice between the poppet head 142 and the seat 144. The rotational position information is transmitted to the surface controller 30 by means of the control line 47.

Thus, it can be seen how sequential incremental movements of the solenoid core 179 produces incremental rotational movements of the stem 196 which in turn either opens or closes the poppet valve formed by the poppet head 142 and the valve seat 144 in corresponding incremental movements. The interruption of flow through the coils 176 and 177 allows the core 179 to remain in the neutral position. Therefore, the size of the flow orifice of the poppet valve remains in a position stable configuration until additional current pulses flow through the solenoid coils.

As can be seen from the above embodiments of the flow control valve used in the present invention, there are two basic configurations of flow control mechanisms. One is a poppet type valve and the other is a rotary type valve.

Figure 4:
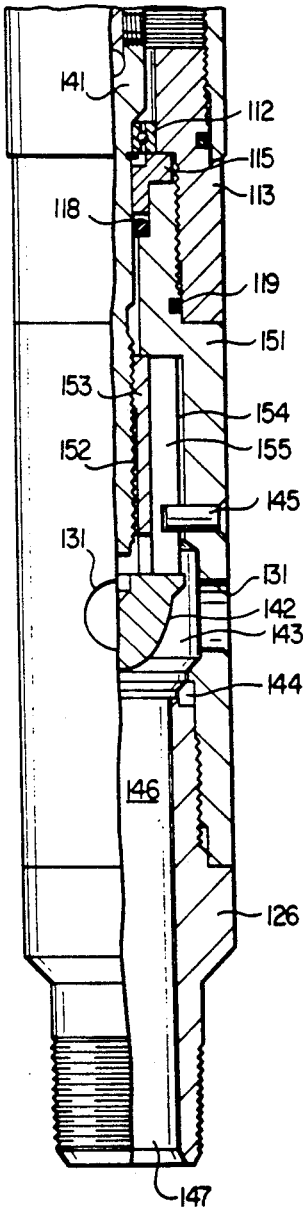
FIG. 4 is a partially cut-away and cross-sectioned view of one end of a flow control valve including a rotary actuated non-rising stem poppet valve.

Referring now to FIG. 4, there is shown in more detail a configuration of the non-rising stem poppet type valve and its manner of operation as a function of the rotation of the rotary drive shaft which controls the movement of the valve.

In FIG. 4, there is shown a partially cross-sectioned view illustrating the construction of the poppet valve actuator used in the flow control valve of the present invention. A rotary drive shaft 141 is journaled within a ball bearing 112 positioned within a bearing housing 113. The bearing 112 is positioned by means of a retainer ring 115 above a bushing 116 which is held in position by the upper end of a port sub 151 which is threadedly engaged with the bearing sub 113 and sealed thereto by means of an O-ring 119. An O-ring 118 provides a further seal along the shaft of the rotary drive 141. The lower end of the rotary drive 141 includes external helical threads 152 which engage the internal helical threads 153 of an axial bore formed within a poppet valve shaft 154. The lower end of the poppet valve shaft 154 has attached thereto a poppet valve head 142 and a longitudinally extending slot 155 running the length thereof. The slot 155 is engaged by means of a spiral pin 145 which extends through an aperture in the outer wall of the port sub 151. The spiral pin 145 in engagement with the longitudinal slot 155 prevents the valve shaft 153 from rotating and only allows movement of the shaft 154 in the axial direction.

The outer wall of the port sub 151 includes a plurality of orthogonally disposed flow intake ports 131 which open into an internal valve cavity 143 which overlies a poppet valve seat 144 positioned at the upper end of a bottom sub 126. The bottom sub 126 is in threaded engagement with the lower end of the port sub 151. The outer surface of the poppet head 142 is configured for engagement with the circular poppet seat 144 to provide a sealing action there between to prevent flow from the chamber 143 into an axial passageway 146 extending the length of the bottom sub to the opening 147 at the lower end thereof. When the poppet head 142 is spaced from the poppet seal 144, fluid flow is permitted from the outside of the valve through the flow intake ports 131, the flow chamber 143, the axial passageway 146 and out the opening 147 in the lower end of the bottom sub 126. As can be seen, rotation of the drive shaft 141 rotates the external threads 152 on the lower end thereof. The threaded rotating engagement with the internal threads 153 in the valve shaft 154 causes axial movement of the valve shaft and therefore movement of the poppet valve head 142 toward and away from the poppet seat 144 depending upon the direction of rotation of the shaft. In either case, the degree of flow allowed through the effective valve orifice between the poppet head 142 and the poppet seat 144 is a direct function of the distance therebetween and therefore the rotational position of the drive shaft 141.

As can also be seen from FIG. 4, the position of the flow orifice between the poppet head 143 and the poppet seat 144 is position stable. That is, when the drive-shaft 141 is held in a fixed rotational position, the flow orifice of the valve is not changed. Finally, it can be seen from FIG. 4 that the rotational position of the drive shaft 141, from some preselected reference point, can be directly correlated with the degree of flow opening which is allowed through the valve. In this way, the degree of opening can be constantly monitored by means of monitoring the rotational position of the drive shaft 141.

Figure 5:
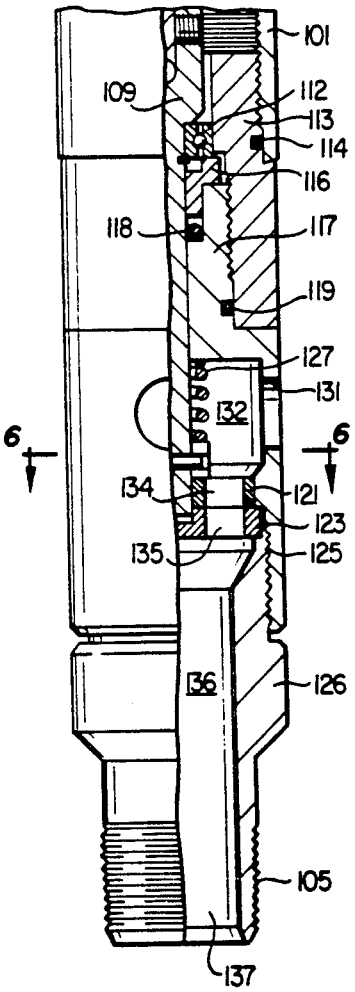
FIG. 5 is a partially cut-away and cross-sectioned view of a rotary, lapped, shear seal valve.

Referring now to FIG. 5, there is shown an enlarged view of the rotary flow control valve portions which are used in the flow control valve of the present invention. As shown, a rotary drive shaft 109 is also mounted within a ball bearing 112 which is positioned within a bearing housing 113 by means of a retainer ring 115 and a bushing 116. The bushing 116 is held in position at the upper end of a port sub 117 which is threadedly engaged with the lower end of the bearing sub 113 and sealed thereto by means of an O-ring 119. An O-ring 118 provides an additional sealing means between the bushing 116 and the rotary shaft 109. The upper end of the bearing bushing 113 is sealed to the outer housing of the valve 101 by means of threaded engagement and an O-ring 114.

The lower end of the rotary drive shaft 109 is attached to an upper rotary valve plate 121 which overlies a stationary valve plate 123. The rotary valve plate 121 is fixed to the end of the shaft 109 by means of a spiral pin 122. The rotary valve plate 121 is pressed into shear sealing engagement with the upper surface of the stationary valve plate 123 by means of a helical valve spring 127 to prevent leakage between the respectively moving parts. The port sub 177 includes a plurality of orthogonally positioned flow intake ports 131 which are in fluid communication with a valve chamber 132. The rotary valve plate 121 includes a plurality of flow ports 134 while the stationary valve plate 123 includes a plurality of flow ports 135 which can be rotationally positioned to be in either more or less alignment with one another to control the flow therethrough. Flow from outside the valve body passes through the flow intake port 131 into the valve chamber 132 and through the aligned ports 134 and 135 into a longitudinal flow channel 136 through the bottom sub 126 and out the opening 137 in the bottom of the valve. As can be seen from FIG. 5, the rotational position of the rotary drive shaft 109 controls the degree of alignment of the ports 134 in the rotary valve plate 135 with the ports 135 in the stationary valve plate 123 to thereby control the degree of flow permitted from the flow intake ports 131 to the opening 137 in the bottom sub 126. As can also be seen, the position of the flow control valve, formed by the rotary plate 121 and the stationary plate 125 and the flow ports 135 and 135 therein, are position stable. That is, when the drive shaft 109 is stationary, the degree of alignment between the ports 134 and 135 is stable and hence the flow permitted therethrough is constant. Rotation of the drive shaft 109 in one direction increases the degree of alignment between the ports 134 and 135 and rotation of the drive shaft 109 in the opposite direction decreases the degree of alignment between the ports 134 and 135. The rotational position of the drive shaft 109 may also be directly correlated to the degree of alignment of the ports 134 and 135 and hence the amount of flow which is permitted through the effective orifice of the valve. Thus, monitoring the rotational position of the drive shaft 109 gives an indication of the degree of opening through the effective orifice of the valve and enables monitoring of the size of that orifice at the surface as a function of the position of angular rotation of the drive shaft 109.

Figure 6A:
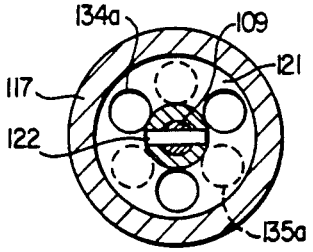
FIGS. 6A, 6B and 6C show various configurations of orifice plates used with the rotary valve embodiments of the present system.
Figure 6B:
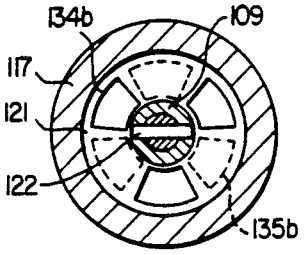
Figure 6C:
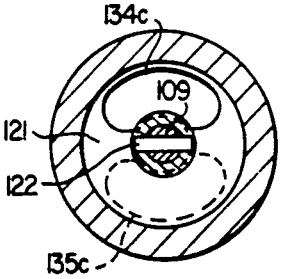

Referring now to FIG. 6A-6C there are shown a plurality of different possible configurations of the rotary valve plate 121 and the stationary valve plate 123 of the rotary valve assembly shown in FIG. 5. Referring first to FIG. 6A, there is shown a cross-sectioned view taken about the lines 6—6 of FIG. 5 illustrating a first configuration of the flow control ports. The three ports **134*a* in the rotary valve plate 121 are shown to be circular and overlying the stationary valve plate 123 containing three circular apertures 135*a* as well. In the port configuration shown in FIG. 6A, the flow control valve is closed since the apertures 134*a* in the rotary valve plate 121 and the ports 135*a* in the stationary aperture plate 123 are totally misaligned to prevent flow therethrough. The degree of alignment between the ports 134*a* and 135*a*** in the respective rotary and stationary valve plates control the degree of flow through the effective orifice of the valve, with a variation from full open to full closed being accomplished by a rotation of 60 degrees.

Referring now to FIG. 6B, there is similarly shown a cross-sectioned view of the port sub 117 of the valve taken about the line 6—6 of FIG. 5 illustrating a slightly different configuration of valve ports. As shown in FIG. 6B, the three flow ports in the rotary valve plate 121 are generally pie-shaped and the ports **135*b* in the stationary valve plate are also pie-shaped. This port design is similar to those in the round ports of FIG. 6A except that the ports are segments of a circle. Each of the sides of the ports 134*a* and 135*b* are straight radial planes which makes the percentage opening produced by alignment of ports 134*a* and 135*b* an equal percentage of a full opening. While the formation of the pie-shaped ports is slightly more expensive than the circular ports, the added degree of indexing control enhances the functionality of the valve. As can be seen from FIG. 6B, the degree of alignment between the ports 134*b* in the rotary valve plate 121 with the ports 135*b* in the stationary valve plate 123** determines the degree of flow which would be permitted through the effective orifice of the valve, with a variation from full open to full closed being accomplished by a rotation of 60 degrees.

Referring next to FIG. 6C, there is shown a third configuration of valve ports which may be used in the rotary valve embodiments of the present invention. FIG. 6C illustrates a cross-sectional view taken along the lines 6—6 from FIG. 5. The rotary valve plate 121 has a single kidney-shaped port **134*c* formed therein and the stationary valve plate 123 has a single kidney-shaped port 135*c* formed therein. The degree of overlap between the ports 134*c* and 135*c* determines the degree of flow through the valve control ports. In the configuration of 6C, there are 180° of shaft rotation in the relative alignment of the respective rotary and stationary valve plates from full open to full closed. In addition, the ends of the circular slots 134*c* and 135*c*** forming the kidney-shaped ports, can be also squared to produce a constant percent of opening per degree of revolution.

As can be seen from the configurations of valve ports shown in FIG. 6A-6C, each of the configurations includes a wiping-type seal, similar to a floating seat type of gate valve, between the rotary valve plate 121 and the stationary valve plate 123. The various configurations determine the degree of rotation necessary to go from full open to full close of the valve and, in addition, the shape and size of the flow ports affects the size of the effective flow orifice as well as a relationship of area to flow as a function of the angle of rotation of the rotary plate with respect to the stationary valve plate.

Referring now to FIG. 7, there is shown a partially cut-away longitudinal cross-sectioned view of the linear to rotational translation means used in certain embodiments of the flow control valve. In particular, the embodiments shown in FIGS. 3C and 3D employ a mechanical spring clutch ratchet mechanism for translating longitudinal movement of a driving shaft into rotational movement of a drive shaft in order to operate the valve sealing mechanisms of those embodiments of the invention. As shown in FIG. 7, the ratchet housing 180 contains a cam sleeve 182 which surrounds a pair of clutch mechanisms, discussed above, and a helical spring 217. A longitudinally extending key slot 206 receives a pair of dowel pins 205 and 212. The opposed ends of the cam sleeve 182 include slightly angulated slots 204 and 214 which are angled in opposite directions from one another at a circumferentially directed angle from the axial and are each at a slightly different angle from one another.

A mechanism within the drive portion of the valve, such as a solenoid or pressure pulse actuator, applies axial motion to the cam sleeve 182 to move it in either the upward direction, as shown by arrow 220, or in the downward direction, as shown by arrow 221. Upward movement of the cam sleeve 182, in the direction of arrow 220, causes the sleeve to move the upper dowel pin 200 along the angulated slot 204 to rotate the underlying drive mechanisms to which the pin is attached, and therefore rotate the stem 196 through a preselected degree of circumferential angular movement. When the sleeve 182 again returns from the upward position to the central position the internal mechanisms are gripped by the spring clutches and does not return from the angular movement it experienced. Similarly, when the cam sleeve 182 is moved in the downward direction, the direction of arrow 221, the dowel pin 213 is caused to move along the angulated section of the slot 214 so that the stem 196 is moved in the opposite angular direction by a preselected degree of angular rotation. When the cam sleeve 182 moves upwardly again to the central position the spring clutches prevent the stem 196 from returning to its previous angular position. The mechanism of FIG. 7 translates the axial movement of various drive means into rotational movement in order to effect the changes in effective valve orifice size within the system.

Because the upper and lower angular slots 204 and 214 are angled slightly different degrees with respect to the longitudinal axis of the cam sleeves 182 a stroke of the cam sleeve 182 in the closing direction differs from the stroke in the opening direction by, for example, about 20%. Thus, when the actuator is "pulsed closed" one pulse, and then "open" one pulse, the net movement of the valve is only 20% of the indexing stroke. This gives a net resolution of about 20% of the stroke provided by the cam sleeve and spring ratchet, for finer resolution of positioning.

Figure 8:
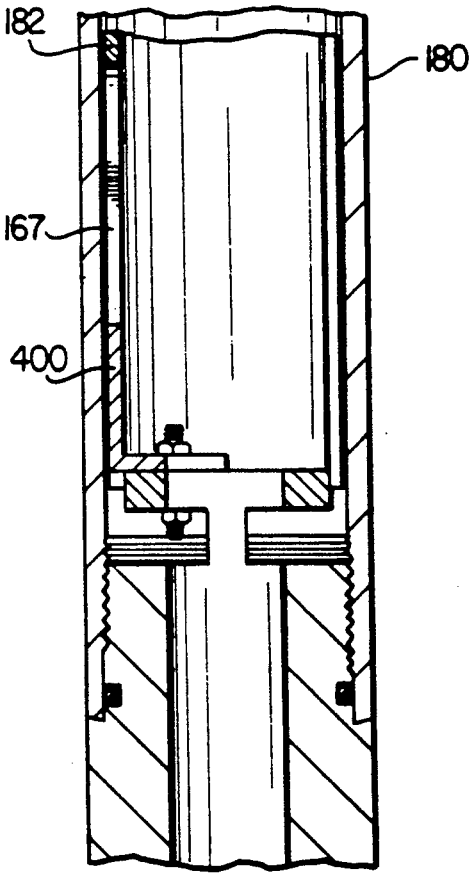
FIG. 8 is a cross-section view illustrating an alternative means of attachment of a key to the cam sleeve and its relationship to the valve housings.

Referring now to FIG. 8, there is shown a longitudinal cross-sectioned view of an alternative means of attachment of a key 400 to the cam sleeve to prevent its rotation.

Figure 9:
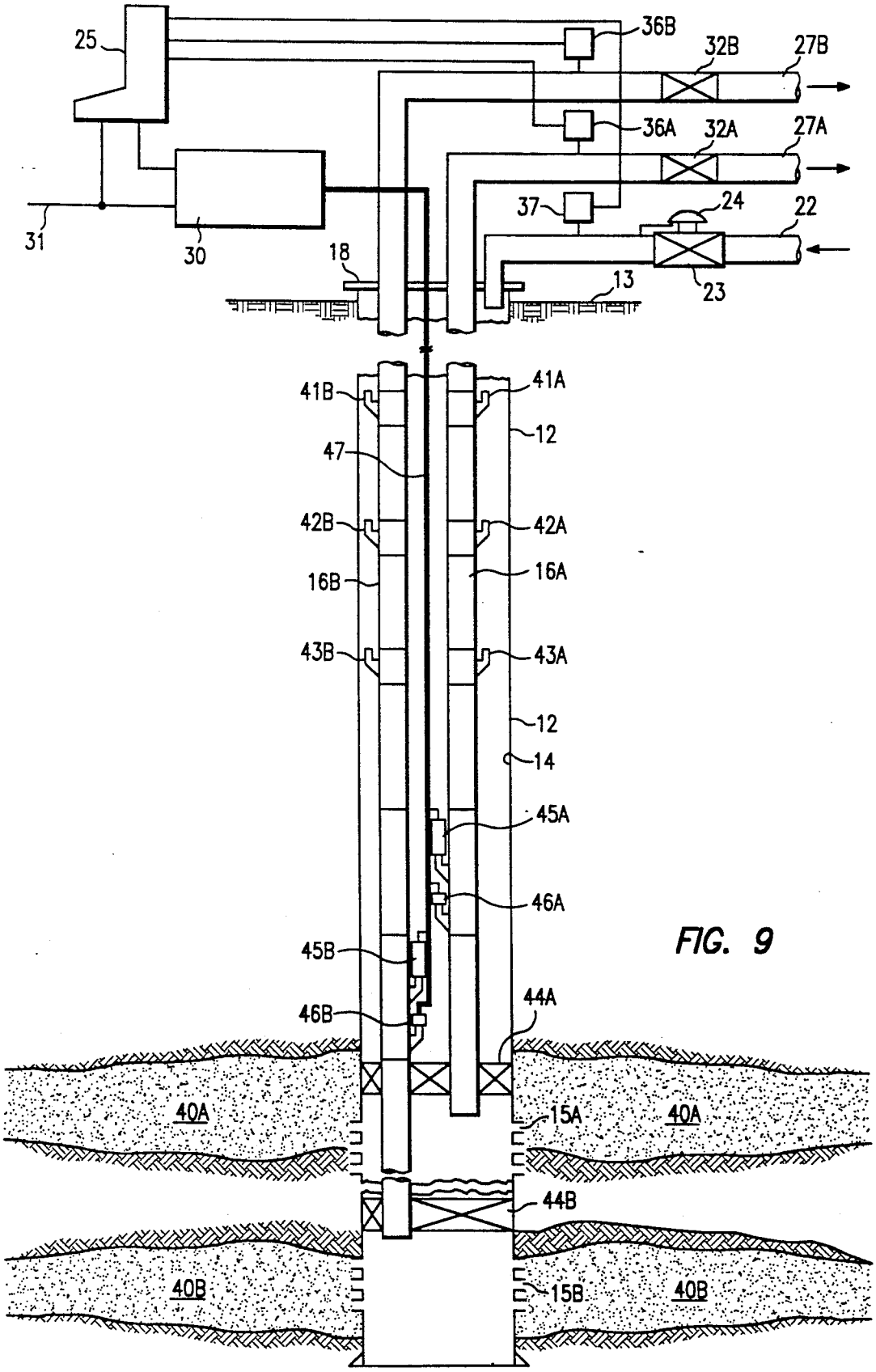
FIG. 9 is a schematic drawing of a dual gas lift well completion including a system constructed in accordance with the teachings of the present invention.

Referring next to FIG. 9, there is shown an illustrative schematic of a well equipped in a dual completion gas lift configuration. The well includes a borehole 12 extending from the surface of the earth 13 which is lined with a tubular casing 14 and extends from the surface down to separate underground hydrocarbon producing formations or geological strata 40A and 40B. The casing 14 includes a first group of perforations 15A in the region of the upper producing strata 40A to permit the flow of fluids from the formation into the casing 14 lining the borehole and second group of perforations 15B in the region of the lower producing strata 40B to permit the flow of fluids from the formation into the casing 14 lining the borehole. The producing strata 40A and 40B into which the borehole 12 and the casing 14 extend are formed of porous rock and serve as a pressurized reservoir containing a mixture of gas, oil, water or other fluids. The casing 14 is perforated along the region of the borehole 12 containing the producing strata in areas of 15A and 15B in order to allow fluid communication between the strata and the well. Two strings of tubing 16A and 16B extend into the borehole from a well head 18 located at the surface above the borehole 12 which provides support for the strings of tubing 16A and 16B extending into the casing 14 and closes the open end of the casing. The first string of tubing 16A terminates in the region adjacent the perforations 15A in the region of the upper strata 40A while the second string of tubing 16B terminates in the region adjacent the lower perforations 15B in the region of the lower strata 40B. The casing 14 is connected to a line 22 which supplies high pressure lift gas through a first flow control valve 23 from an external source such as a compressor (not shown) into the casing 14.

The first string of tubing 16A is connected to a production flow line 27A through a second valve 32A while the second string of tubing 16B is connected to a production flow line 27B through a third valve 32B. The output of the flow lines 27A and 27B comprise production fluids from the well which are connected to a collection means such as a separator (not shown). The output flow of the two strings of tubing 16A and 16B into the production flow lines 27A and 27B is generally a mixture of both fluids, such as oil, water and condensate, and gases and is directed to a separator which affects the physical separation of the liquids from the gases and passes the gas into a gas gathering system for sale or recompression. The liquid output from the separator is directed into a liquid storage reservoir for subsequent sale or disposal depending upon the type of liquid produced. A computer 25 is connected to receive information from a series of pressure transducers 36A and 36B connected to flow lines 27A and 27B respectively, and to a pressure transducer 37 connected to the gas injection flow line 22. Both the computer 25 as well as a downhole valve controller 30 connected thereto are supplied by electrical power from a source 31 which may be AC or DC depending on the facilities available.

While a gas lift completion itself may include either single or multiple completions there is shown in FIG. 9 a dual completion comprising a plurality of conventional gas lift valves 41A–43A connected in the first string of tubing 16A along with a plurality of conventional gas lift valves 41B–43B connected in the second string of tubing 16B. A pair of remote control gas lift valves 45A and 45B are connected into the first and second tubing strings 16A and 16B, respectively, just above a pair of pressure transducers 46A and 46B. Both the remote control gas lift valves 45A and 45B and the pressure transducers 46A and 46B are connected via a control line 47 to the controller 30 located at the surface. The control line 47 is preferably electric and is preferably a two conductor, coaxial, polymer insulated cable protected with a small diameter stainless steel tubing outer shell. The control line 47 supplied both electrical power and electrical operating signals to control the operation of the gas lift valves 45A and 45B from the controller 30. It also carried information related to the operational condition of the gas lift valves 45A and 45B and information from the pressure transducers 46A and 46B to the controller 30.

The variable gas lift injection pressure control valve 23 includes a remote control mechanism 24 which may be operated under control of the computer 25.

As can be readily understood, the dual completion system of FIG. 9 can be used to optimize the production flow from the two strings of tubing 16A and 16B by individually controlling the size of the opening of each of the flow control gas lift valves 45A and 45B. Since each geological formation from which the two strings or tubing produce may have separate pressure and/or flow characteristics, independent control over each of the two flow control orifices connected to a common source of pressurized lift gas within the casing 14 enables optimization of production from the two separate underground reservoirs. Control over the valves can be implemented based upon pressures and temperatures monitored downhole and/or upon various flow parameters monitored at the surface.

Figure 10:
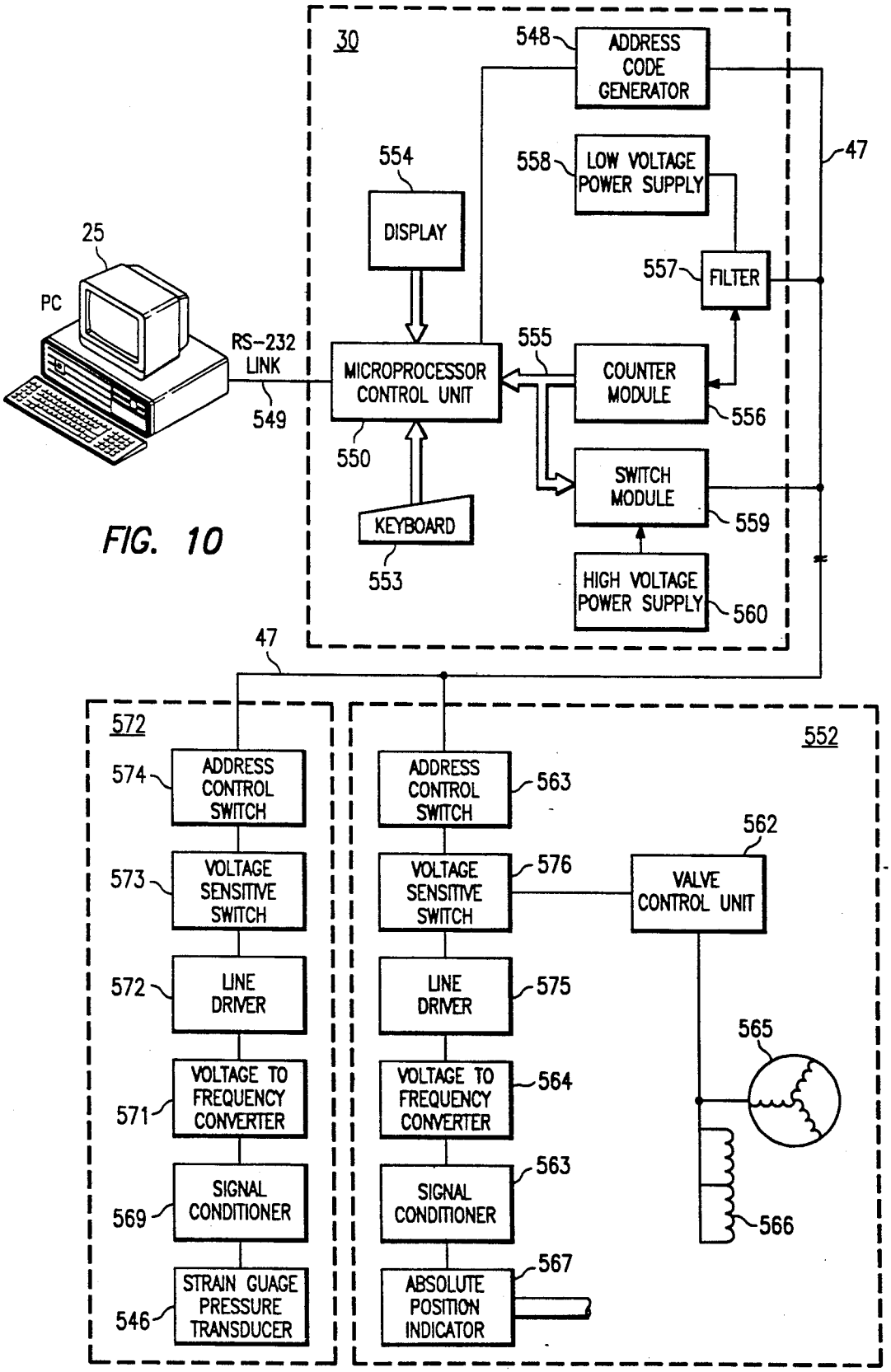
FIG. 10 is a block diagram of the monitoring and control components of the system of the present invention.

Referring next to FIG. 10, there is shown a block diagram of the electrical control and monitoring components of the system of the present invention. The system includes a surface electronic package including the computer 25 and the controller 30 connected to an illustrative pair of downhole electronic packages 552 and 572 by means of the control line 47. The controller 30 includes a microprocessor control unit 550 which includes means to receive an input from external sources, such as a keyboard 553, and to display various operational parameters at a visual display 554. The microprocessor control unit 550 both sends information downhole and receives information from downhole by means of a digital communications bus 555 connected to a counter module 556 coupled to the control line 47 through a filter 557. Power is supplied to both the surface electronic components as well as the downhole electronic components by means of a low voltage power supply 558. The microprocessor control unit 550 also controls by means of a bus 555 a switch module 559 which regulates the application of high voltage power supply pulses from a power supply 560 onto the control line 47. Communications between the PC 25 and the microprocessor control unit 550 are preferably digital and affected by means of the RS232 serial communications protocol link 549. As will be discussed in greater detail below, the data separation, modulation and transmission techniques taught in U.S. Pat. No. 4,568,933, hereby incorporated by reference, may be used in the downhole communication portion of the system in the present invention.

The microprocessor control unit 550 is also connected directly to the control line 47 through an address code generator 548 which applied a digital code to the line to address selected ones of the downhole components of the system for either receiving downhole information monitored from that component, delivering control pulses to that component, or changing the operating conditions of the valve. Each downhole component includes an address control switch which is responsive to the signals generated by the address code generator to only enable that particular component if it is one which has been selectively addressed by the address code generator 548.

It should be noted, with reference to FIG. 9, that the system of the present invention will support a plurality of different parameter monitoring modules as well as a plurality of different remotely controlled variable orifice valves. Downhole monitoring module 572 may be used to supply control unit 550 with the value of downhole parameters such as production fluid flow rate, pressure and temperature or lift gas flow rate, pressure and temperature. The present invention allows monitoring of the downhole parameters which are best suited to optimize production from the associated underground reservoir. The block diagram of FIG. 10 illustrates one each of such parameter monitoring modules as well as a valve control and position monitoring module. It should also be understood that the system of the present invention may also include only a single parameter monitoring module, and valve position monitoring and control module, as is shown in FIG. 10, and in which case no address code generator or address control switches are necessary in order for the system to monitor and control such single component installations.

Referring again to FIG. 10, the downhole component monitoring module 572 may include a strain gauge pressure transducer 546 connected to monitor the tubing pressure at the location of the transducer within the tubing. The pressure transducer 546 is connected through a signal conditioner 569 to a voltage to frequency convertor 571. The output of the voltage to frequency convertor 571 is connected to a line driver 572 which supplies sufficient power to the output signal to transmit it along the control line 47 to the surface. A voltage sensitive switch 573 allows low voltage DC operating current to be supplied from the control unit 30 at the surface down the control line 47. The voltage sensitive switch 573 also blocks high voltage current pulses, sent from the surface along the same control line 47 to change the position of the valve, from damaging any of the sensitive electronic equipment within the monitoring module 572. The operation of the voltage sensitive switches 573 and 574 will be explained in further detail below. An address control switch 574 responds to the receipt of a particular address signal, sent from the address code generator 548 at the surface, and allows the surface unit to selectively access each particular downhole module component. For example, one address would allow the surface unit 30 to monitor measured parameter signals produced by the pressure transducer 546 within module 572 and receive those signals uphole.

The downhole valve control and monitoring module 552 includes a valve control unit 562 which controls the current delivered to either a rotary motor actuation system 565 or a linear motion actuation system such as a solenoid 566. As was described above, the flow control valve employed in the system of the present invention may be provided in two different embodiments including different means of valve actuation such as either linear or rotary drives. The valve control and monitoring module 552 also includes an absolute position indicator 567 which is connected to the variable orifice valve itself to produce a signal indicative of the actual size of the value aperture at each moment. The output of the absolute position indicator 567 is connected to a signal conditioner 563 the output of which is in turn connected to a voltage to frequency convertor 564, which converts the signals related to the valve position into a selected frequency for transmission to the surface. The output of the voltage to frequency convertor 564 is connected through a line driver 575, a voltage sensitive switch 576 and an address control switch 563 to the control line 47 leading to the surface. As in the case of the downhole parameter monitoring module 572, the voltage sensitive switch 576 serves to isolate the valve control unit 562 from loading down the DC current supplying the position monitoring circuits with operating power while at the same time allowing the passage of high voltage current pulses to the valve control unit 562 to change the position of the valve.

The orifice size of the valve may be selectively controlled from the surface via the control line 47 and the valve control unit 562. The flow control valve includes an absolute position indicator 567 which provides a signal indicating the absolute position of the valve orifice, through the signal conditioner 563, the voltage to frequency convertor 564, the line driver 575 on to the control line 47. The monitoring module 572 includes a downhole pressure transducer 564, which is shown to take the form of a strain gauge pressure transducer 546, connected to a signal conditioner 569, such as an overvoltage protection circuit, and a voltage to frequency convertor 571, for communication of the pressure information uphole to the surface electronic package 30 through the control line 47. In addition, it should be well understood that other parameter measurement means such as downhole temperature or flow rate indicators (not shown) may also be provided as monitoring components in the subsurface electronic monitoring package 572.

The surface electronic control unit 30 monitors downhole pressure information from the strain gauge pressure transducer 546 and position information from the valve absolute position indicator 567 which indicates the current position of the flow control orifice of the flow control valve. In addition, the surface control electronics package 30 sends power and control signals downhole via the control line 47. The microprocessor control unit 550 controls the application of high voltage power pulses from the high voltage power supply 560 through the switch module 559 to the control line 47 for changing the size of the orifice in the flow control valve.

In general, the surface control unit 30 provides an interface between the computer 25, the transducers 546 and 567 located downhole, the electrically controlled valve, which may be used as a gas lift valve, and the operators of the system. The controller 30 operates the valve, supplies power to the downhole components and separates the monitoring signals produced by the transducers 546 and 567 from one another. Information telemetered from the downhole control modules 572 and 552 is displayed at the display 554 of the controller 30. In addition, the computer 25 also monitors other well parameters, such as the pressure transducers 36A, 36B, and 37, and controls other well components such as valve 23 in order to effect a coordinated well control system related to both downhole and surface operating conditions. For example, in one such control arrangement, the system monitors the flow rate from the flow lines 27A and 27B at the surface and controls the downhole gas injection rates to minimize the degree of fluctuations in the production and thereby optimize the production from the wall.

As discussed above in conjunction with FIGS. 3A–3D, several embodiments of the downhole flow control valve are employed in conjunction with the system of the present invention. These include two different valve designs and two different actuator designs with different combinations of actuators and valves being used in particular embodiments. The two exemplary valve designs employed in the several embodiments include a non-rising stem poppet valve configuration and a rotary, lapped, sheer seal valve configuration. The two exemplary actuator designs employed include a stepper motor with gear reduction and a linear solenoid with a linear to rotary motion convertor, such as a wire clutch differential ratchet mechanism and indexing cam. Each of various embodiments of the flow control valve employed in the system of the present invention are set forth above in conjunction with FIGS. 3A–3D.

As pointed out above, the circuitry of FIG. 10 allows the system to supply low voltage operating current to the downhole components over the same control cable as relatively high voltage current pulses used to change the position of the valve. Voltage sensitive switch circuitry is included which allows the monitoring components of the system to continuously receive low voltage operating current while at the same time protecting them by taking them off line upon the occurrence of relatively high voltage actuation pulses used to change the position of the valve. Similarly, voltage sensitive switch circuitry is provided which prevents the valve operating components, such as motor winding solenoid coils, from providing a continuous drain on the low voltage operating current coming down the control cable 47. The voltage sensitive switch circuit normally disconnects them from the cable until the occurrence of a relatively high voltage control pulse which is then coupled through to the valve control unit to vary the position of the valve.

Figure 11:
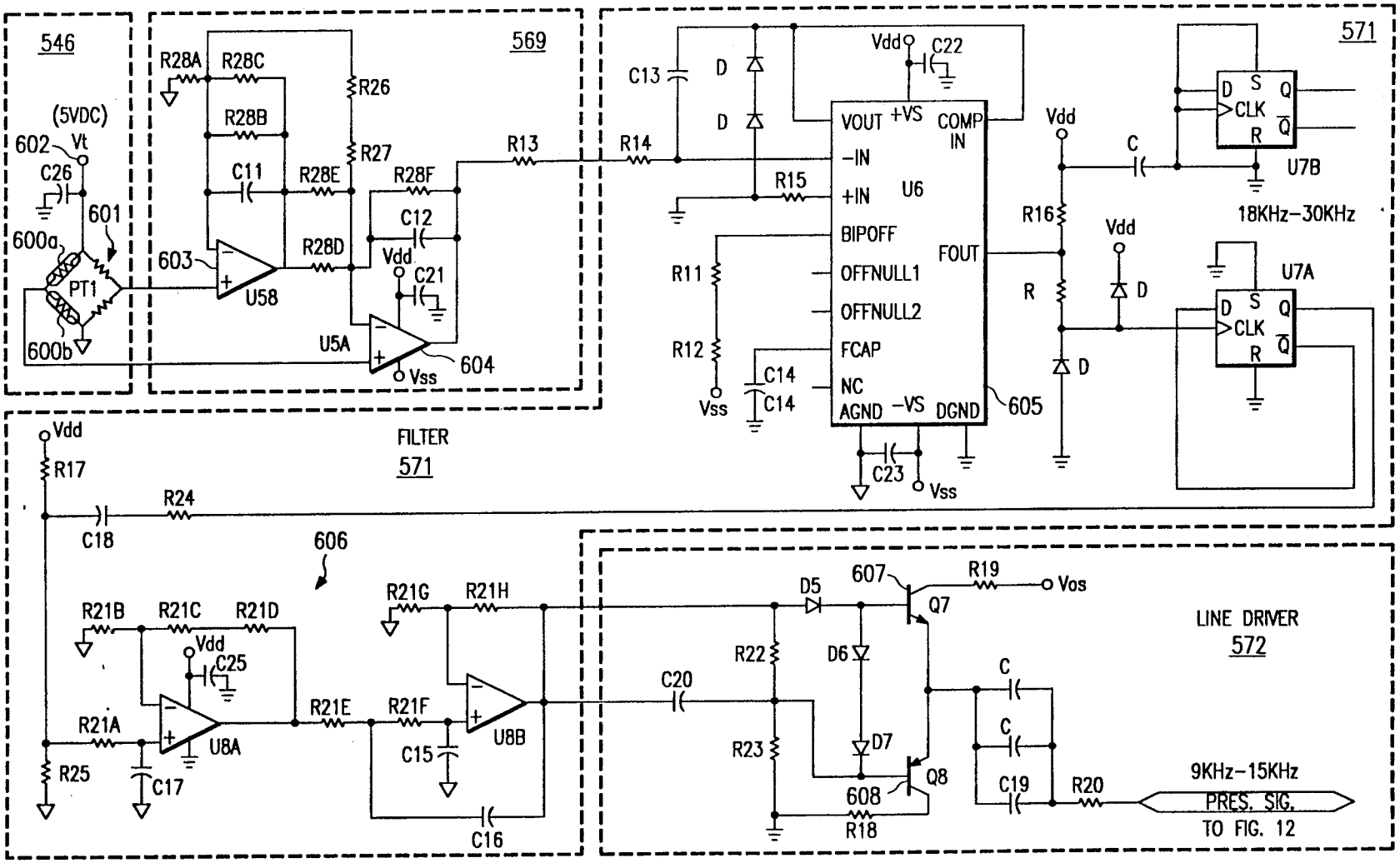
FIG. 11 is a schematic diagram of one embodiment of the monitoring components shown in FIG. 10.

Referring next to FIG. 11, there is shown a schematic diagram illustrating some of the components of the downhole monitoring module 572. In particularly, there is shown a schematic diagram of the strain gauge pressure transducer 546, the signal conditioner 569, the voltage to frequency convertor 571, and the line driver 572. As shown in FIG. 11, a pressure sensitive bridge circuit 601, containing a pair of pressure sensitive resistors **600*a* and 600*b*, is connected to a precision voltage source 602 the output of which is thus proportional to the pressure on the resistors 600*a* and 600*b*. The output of the pressure sensor 546 is connected to the signal conditioner 569 comprising an instrumentation amplifier which includes pair of amplifiers U58 and U5A which amplify and buffer the very low voltage signal, in the range of 100 millivolts, coming from the pressure sensor 546. The pressure sensor output is boosted to a voltage on the order of 2½ voltage which is then applied to the input of the frequency convertor 571. The pressure related voltage is applied to the input of a precision voltage to frequency convertor 605 which may comprise a Model AD650 voltage to frequency convertor manufactured by Analog Devices. The output from the convertor 605 consists of a variable frequency in the range of from 18 KHz to 30 KHz which is passed through a filter portion of the circuit 606. The filter 606 divides the frequency of the output signals in half creating a frequency range of 9 KHz to 15 KHz for the pressure information. This is done to define a discrete frequency range for the pressure signals to distinguish those signals from those associated with the valve position indicator which are in the range of 500 KHz to 1500 KHz. The output of the frequency dividing filter 606 is connected to the input of the line driver 572 which include a pair of transistors 607 and 608 which produce a line level output signal in the range of 9 KHz to 15 KHz and which is sent uphole as being indicative of the tubing pressure at the pressure sensor 546**.

Figure 12:
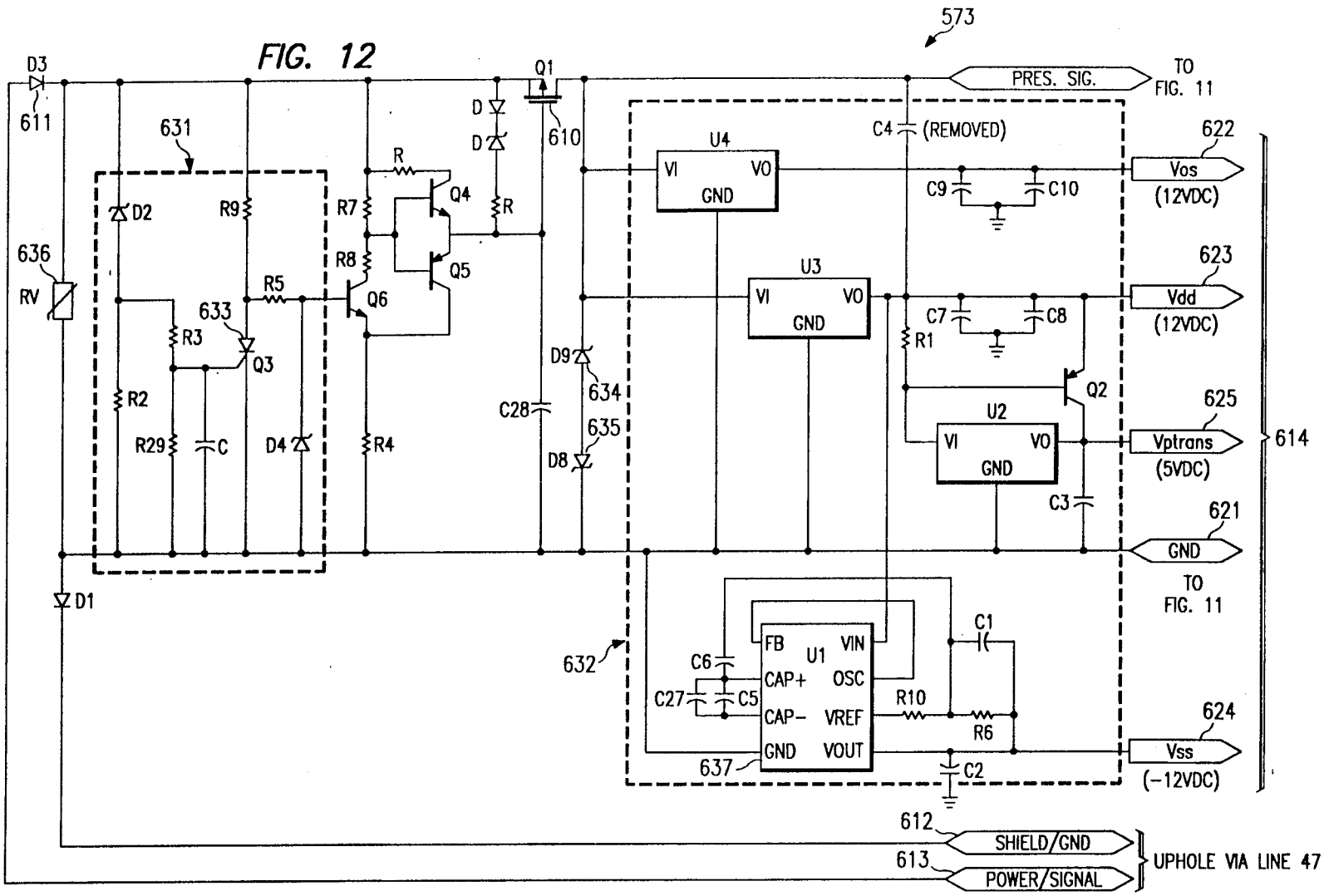
FIG. 12 is a schematic diagram of a voltage sensitive switch circuit for a pressure monitoring system employed in the present invention.

Referring now to FIG. 12, there is shown schematic diagram of the voltage sensitive switch 573. The variable frequency input signal from FIG. 11 is connected through a control field effect transistor 610 and a diode 611 to output terminals 612 and 613 coupled to the control line 47. The ground connection 621 from FIG. 11 is also connected through diode D1 to the ground terminal 612 and also uphole through the control line 47. A group of voltage supply terminals 614 include the ground connection 621, +12 volts DC terminal $V_{os}$ 622, and $V_{dd}$ 623 along with −12 volt DC terminal $V_{ss}$ 624 are connected to various points within the pressure monitoring circuitry to supply operating current. In addition, a precision 5 volts DC terminal $V_p$ 625 is connected to supply current to the pressure transducer 546.

The voltage sensitive switch of FIG. 12 is included to enable the system to operate with only two lines to transmit both control and power signals going downhole and monitoring signals going uphole. Thus, the system includes means for turning off the monitoring circuitry located downhole when high voltage pulses are sent downhole to change the condition of the valve. The high voltage valve control pulses are far above the level that the downhole monitoring circuitry can withstand without damage. The voltage sensitive switch is a way of shutting off the downhole monitoring circuits when the valve control circuitry is powered by high voltage pulses.

In general, the voltage sensitive switch circuitry shown in FIG. 12 includes a circuit for sensing the voltage coming down the control line 47 from uphole, i.e., circuit 631, and a circuit for supplying operating current to the pressure measurement circuitry within the system, i.e., circuit 632. When a voltage on terminals 612 and 613 exceeds the value of about 25 volts a high voltage condition is detected by the circuit 631 which triggers the SCR 633 and operates a trigger circuit 634 which opens the field effect transistor 610. In the event FET switch 610 fails to open in response to a high voltage condition, two Zener diodes 634 and 635 are provided ahead of the power supply circuit 632 as an extra measure of safety. In addition, a varistor 636 is provided across the line 612 and 613 to dissipate any excessive voltage surges and prevent damage to the power supply circuitry. For example, in the event something goes wrong uphole and a high voltage, e.g., on the order of 300 volts is applied across the line, the varistor 636 dampens that voltage surge and allows the circuit to continue to function without damage. Once the high side FET switch 610 is opened, all power supply voltage sources connected to the measurement circuit 632, including inverter 637 which gives the negative 12 volts on terminal 624, are interrupted.

In each case where high voltage pulses are applied to the control line 47 to control the position of the downhole valve, the voltage is taken back to zero following each current pulse. This enables the voltage sensitive switch of FIG. 12 to immediately reset itself and again begin conducting low voltage power to the monitoring circuits. The SCR 633 senses the fact that the voltage across the line has gone to zero which interrupts the control circuit 634 to again enable conduction across the FET 610 and reconnect the power supply circuit 632 to the line. Thus, the voltage sensitive switch of FIG. 12 allows the continuous supply of low voltage current from the control line 47 through to the power supply circuit 632 until it detects a high voltage pulse coming down the line 47. As soon as the voltage on the line exceeds 25 volts, this condition is detected by SCR 633 which in turn triggers the opening of field effect transistor 610 to prevent the application of that high voltage to the power supply circuit 632. As soon as the voltage on the line has decreased again to zero, this condition is detected the SCR 633 which allows transistor 610 to again close and reapply the power supply voltage on the line 47 to the power supply circuit 632.

Figure 13:
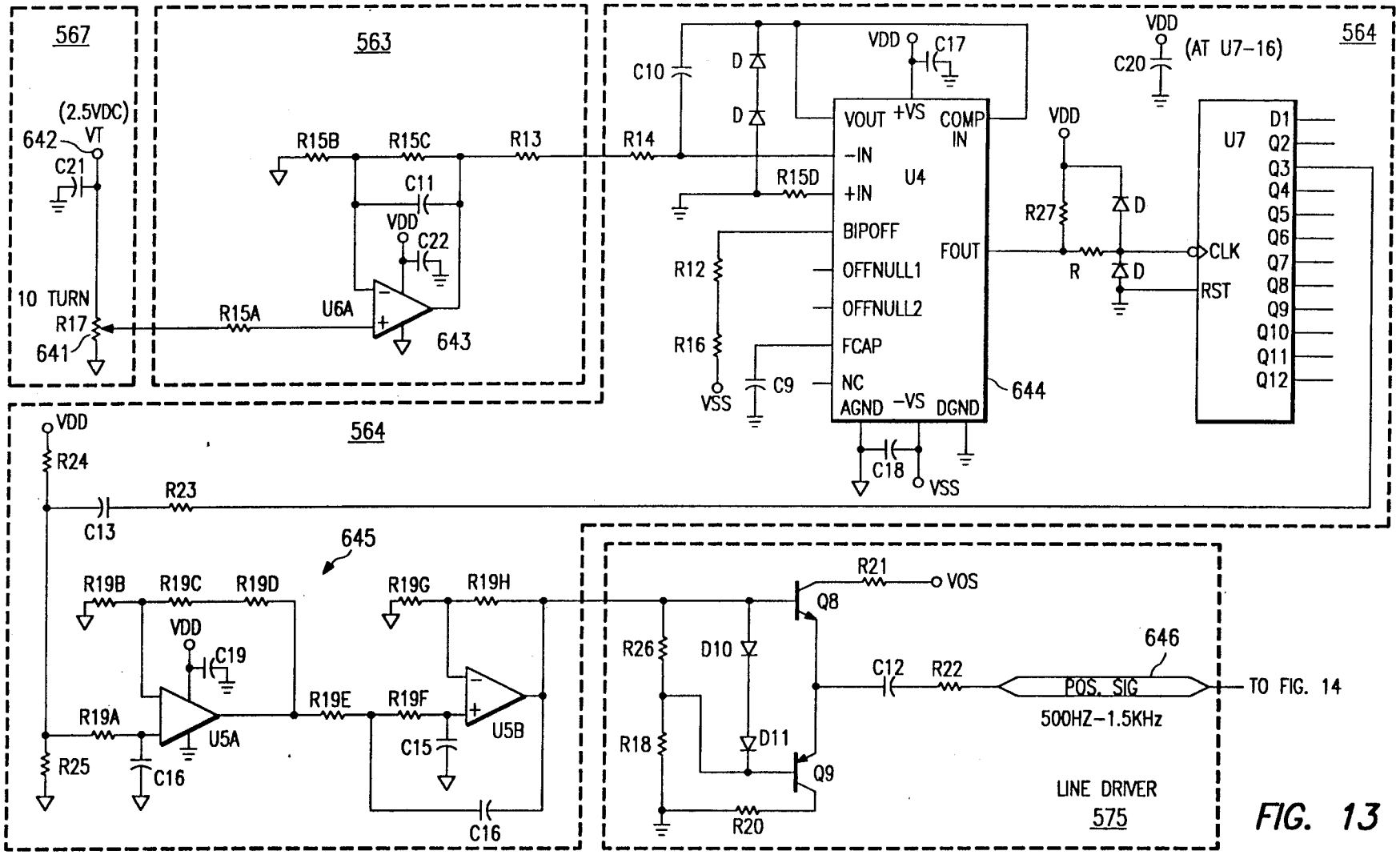
FIG. 13 is a schematic diagram of an embodiment of a valve position monitoring circuitry employed in the present invention.

Referring next to FIG. 13, there is shown a schematic diagram of circuitry included within the absolute position measurement circuitry for the variable orifice valve. A position indicator 567 includes a precision rotary potentiometer 641 which is connected to a precision voltage source 642 supplying approximately b 2.5 volt DC across the potentiometer. The potentiometer 641 is connected to the shaft which controls the position of the valve by means of a gear mechanism. The potentiometer 641 is rotatable 10 full turns from one extreme value of resistance to the other. Thus, the valve position indicator 567 produces an output voltage which is proportional to the position of the valve arm connected to the potentiometer. The output voltage is input to a signal conditioner 563 in which the output voltage is amplified and buffered in amplifier 643 to deliver an output signal to the input of a voltage to frequency convertor 564. Circuit 564 includes a voltage to frequency convertor IC 644 which may comprise a Model AD650 voltage to frequency convertor manufactured by Analog Devices, as in the case of convertor 604 shown in FIG. 11. The output of this device is connected to a filter 645 which converts the frequency value of the signal to the selected frequency range to be used for an indication of absolute value position. The output of the filter 645 is connected to a line driver 575 which produces an output signal on terminal 646 in the frequency range of 500 Hz to 1.5 KHz and which is connected to the control line 47 through the additional circuitry shown in FIG. 10.

Figure 14:
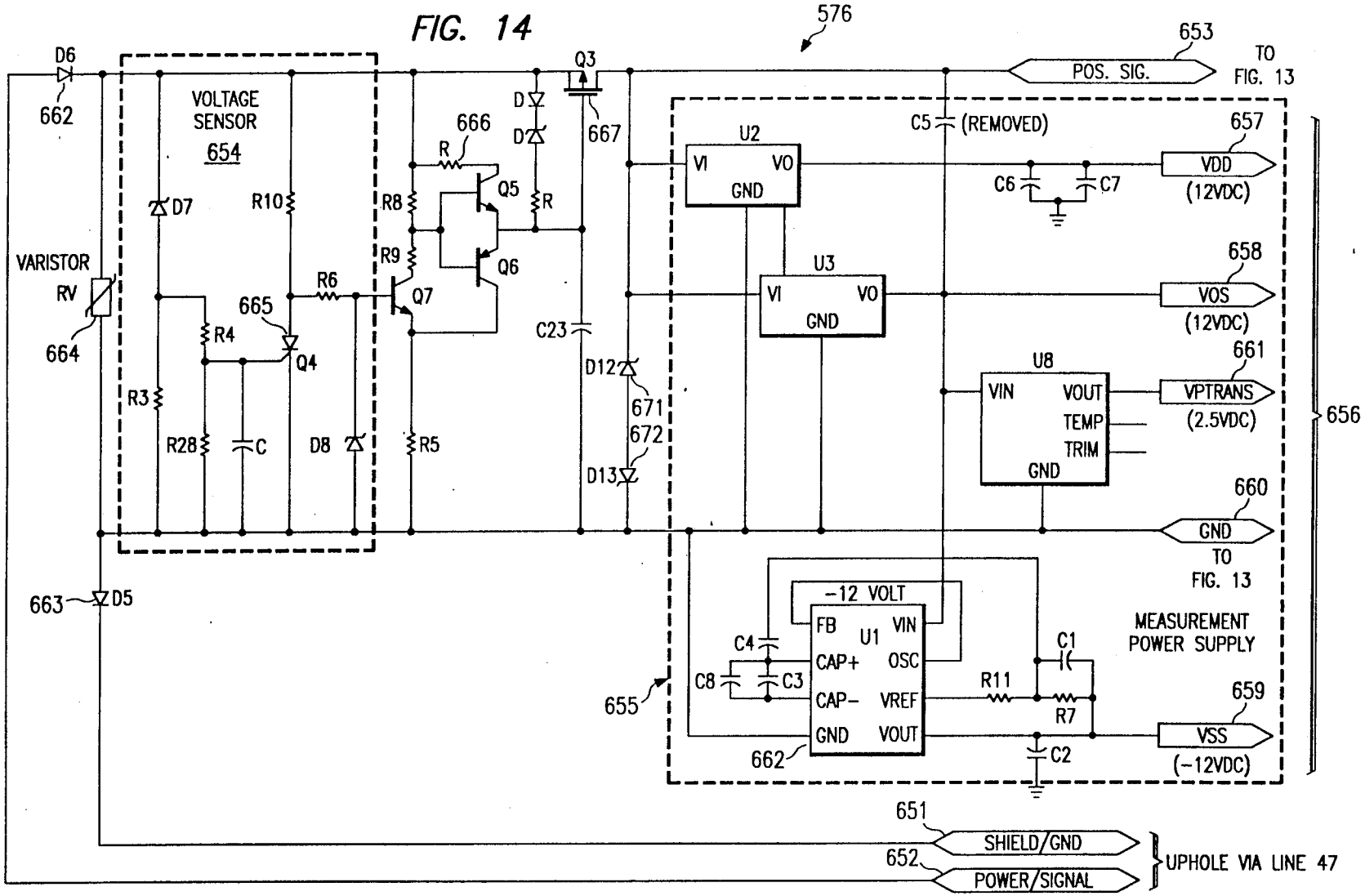
FIG. 14 is a schematic diagram of a voltage sensitive switch circuit for the valve position monitoring components of the present invention.

Referring now to FIG. 14, there is shown a schematic diagram of the voltage sensitive switch 576 of FIG. 10 which includes a connection to the control cable 47 by means of terminals 651 and 652. The frequency encoded valve position signal is connected by means of terminal 653. The circuit includes a voltage sensor section 654 and a measurement power supply section 655. The power supply section 655 has a plurality of output terminals 656 including two +12 volt output terminals, $V_{dd}$ 657 and $V_{os}$ 658, and a −12 volt output terminal $V_{ss}$ 659. A ground terminal 660 as well as a 2.5 precision voltage $V_{ptrans}$ at terminal 661 is also part of the terminal grouping 656. An inverter 662 produces the −12 volt terminal at terminal 659.

In general, the input terminals from the control lines 47 are connected through a pair of diodes 662 and 663 across which is connected a varistor 664 to the voltage sensor section 654. When the voltage on the control line 47 is less than approximately 25 volts, the SCR 655 is not conducting and, therefore, the control circuit 666 does not operate to open the circuit of field effect transistor 667 and the low voltage current is connected to the power supply section 655 to provide output power to the measurement circuitry. If, however, the input voltage on the control line 47, i.e., on terminals 651 and 652, exceeds approximately 25 volts, the SCR 665 begins conduction to actuate the control circuit 666 to open the circuit of FET 667 and interrupt the flow of voltage to the power supply circuit 655. In the event that there is a malfunction in the circuit, the zener diodes 671 and 672 are connected across the power supply circuitry to prevent any damage to the circuitry. Further, the varistor 664 is also provided for voltage protection in the event some exceedingly high voltage is inadvertently applied to the line at the surface.

As can be seen from the voltage sensitive switch of FIG. 14, the application of relatively low voltage dc current to the terminals 651 and 652 is connected directly across the voltage sensor 654 to the power supply of 655 and from there to the position measuring components within the system. When, however, a high voltage pulse is applied to terminals 651 and 652 to change the position of the switch, then the high side switch 667 is opened to interrupt and take the power supply circuit off line until the high voltage has passed. Reduction of the value of the current on the line to zero stops the SCR 665 from conducting which allows the high side switch 667 to again close and power to be reapplied to the power supply circuit 665.

Figure 15:
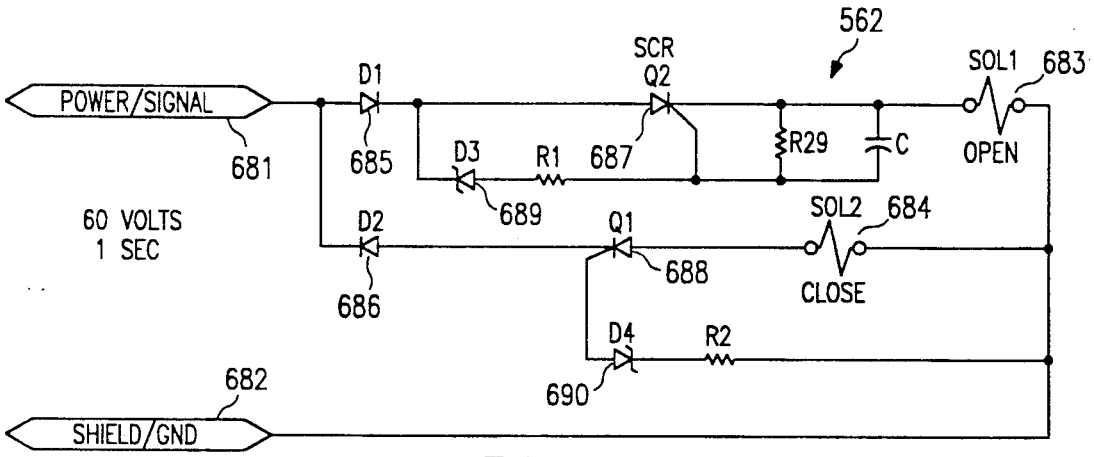
FIG. 15 is a schematic diagram of a valve control unit employed in the system in the present invention.

Referring next to FIG. 15, there is shown a schematic diagram of a valve control unit 562 which includes a pair of input terminals 681 and 682 connected to the control cable 47 leading from the wellhead. The circuitry includes two solenoid coils 683 and 684 which, upon energization, serve to either open the valve an incremental amount, or close the valve an incremental amount, respectively. A pair of diodes 685 and 686 are connected, respectively, in the circuits of solenoid coils 683 and 684. The diodes 685 and 686 are connected in reverse polarity from one another and a pair of SCR's 687 and 688 are connected in series with the diodes 685 and 686, respectively. The diodes 685 and 686 are arranged in opposite polarity so that a pulse in one direction which exceeds approximately 39 volts is allowed to pass through one of the diode legs to turn the associated SCR on and thereby energize the associated solenoid coil. A similar voltage pulse of the opposite polarity, which exceeds approximately 39 volts, is allowed to pass through the other diode and turn on the other SCR to energize the other solenoid coil. As can be seen a pair of zener diodes 689 and 690 establish the trigger level of the respective SCR's 687 and 688. Once a particular solenoid coil has been energized, a reduction of the voltage to zero causes the SCR to turn off and the circuit to reset itself and prepare for the next cycle. The high voltage solenoid operating voltage pulse values applied to the circuit are preferably on the order of about 60 volts for approximately one second.

It should also be noted from the valve control circuitry of FIG. 7 that the normally nonconducting SCR's 687 and 688 prevent the application of the low voltage power supply current to the solenoid coil 683 and 684 and thereby avoid loading the power supply circuits with any current flow through those solenoid coils. This saves power and prevents unnecessary drain on the circuitry downhole.

In effect, the voltage sensitive switch for the valve control unit of FIG. 15 is a mirror image of the voltage sensitive switch for the pressure monitoring circuits of FIGS. 12 and 14. The valve control circuit of FIG. 15 only allows the passage of one polarity or the other of a relatively high voltage dc pulse to actuate the solenoid coils or alternatively, the motor coils of a motor control valve, and does not allow the passage of the low voltage power supply current. In contrast, the voltage sensitive switches of FIGS. 12 and 14 allow the passage of low voltage power supply currents but prohibit the passage of relatively high voltage valve control pulses to protect the monitoring circuits from damage. That is, the valve control unit of FIG. 15 takes the solenoid coils off line whenever the 20 volt standing power supply voltage is present so it doesn't load the power supply line and then puts them back on line whenever the voltage goes above about 39 volts so that the solenoids will be operated by one of the high voltage pulses. In comparison, the voltage sensitive switches of FIGS. 12 and 14 leave the power supply circuits on line when the voltage is below or about 20 volts but takes them off line whenever the voltage goes above about 25 volts. There is a voltage window in between the two to ensure that neither one is on line when it's not supposed to be.

Figure 16A:
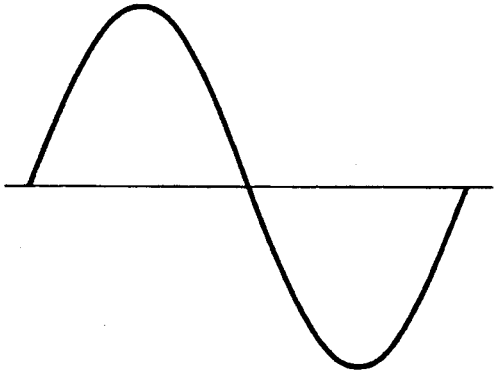
FIG. 16A–C are illustrative waveforms of a valve position signal, a pressure transducer signal, and the combination thereof, respectively, as they occur in certain embodiments in the system of the present invention.

As discussed above in connection with FIGS. 11 and 13, each of the two monitoring circuits produce ac signals which are indicative of the monitored parameters, e.g., pressure and absolute position of the valve, to be sent back uphole. The signal waveforms shown in FIGS. 16A and 16C illustrate those signals. For example, the valve position is represented by a signal of relatively low frequency, i.e., 500 Hz to 1,500 Hz and may be illustrated in the form shown in FIG. 16A. This is a signal produced by the circuit shown in FIG. 13.

Figure 16B:
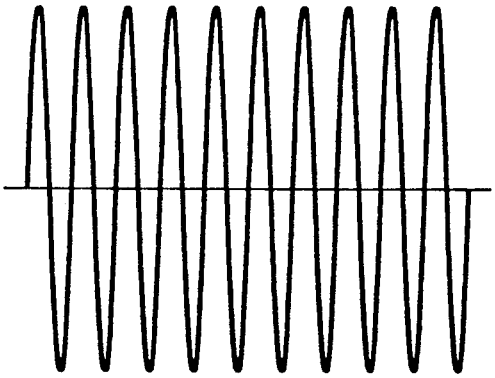
Figure 16C:
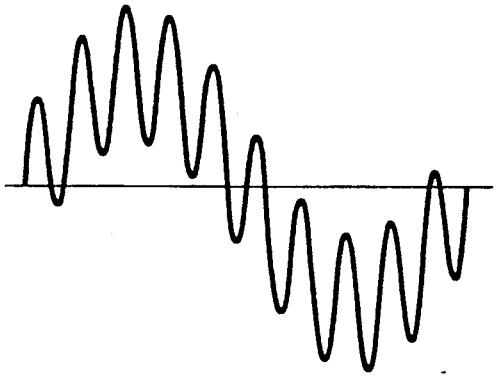

The waveform illustrated in FIG. 16B is that produced by the circuit shown of FIG. 11 and represents the signal value being produced by the pressure transducer. This signal has a frequency on the order of 900 KHz to 1500 KHz, substantially higher than that of the valve position signal. The two combined waveforms are illustrated in FIG. 16C which represents the actual signal which is sent back uphole via the control cable 47 to be decoded by the filter 557 within the control circuit 30 and sent to the counter module 556 for communication to the microprocessor control unit 550.

As can be seen from the system of the present invention, and with particular reference to the dual completion of FIG. 9, the system allows separate control over the orifices of the two separate valves **45*a* and 45*b* of the completion. This allows the system to utilize a common control pressure in the casing 14** but yet to allow different amounts of flow through two gas injection valves. Control of the orifice in each of the separate valves in accordance with the present invention allows optimization of production from two different depths and two different formations. Such an ability to independently adjust the orifice of two separate flow control valves to optimize the production from two different formations at two different depths from a single gas supply within the casing at a common pressure, is a substantial advantage over prior dual completions.

The system of the present invention shown in FIGS. 9 and 10 also allows multiple addressable parameter monitoring circuits and multiple addressable valves. This allows a single control unit at the surface to selectively monitor a plurality of different parameters within the well, including different pressures as well as different flow rates and other parameters, and then selectively change the orifice size setting on different valves accordingly. The provision of selectively addressable components within the valve system allows these advantages.

As in the case of a single well completion illustrated in FIG. 1, the system of the present invention allows the optimization of production from a gas lift completion by minimizing the variations in the production flow surges from such a completion. As is well known in the art, the introduction of injection gas into a casing forces the fluid in the tubing to the surface but when the liquid level in the annulus get down near the gas injection valve, gas begins breaking into the tubing which aerates the liquid column in the tubing and reduces the average density of the fluid in the tubing and the bottom hole pressure. This effect permits more and more gas to flow in which allows the flow control at the surface to get away in the case of a fixed orifice at the surface. Because of the elasticity of the volume of gas in the annulus the rate of gas flow into the tubing flows faster and faster up to the point where so much gas has been flumed through the tubing that the pressure in the casing decreases. Liquid begins dropping back down the well building up the pressure again in the tubing which allows the casing pressure to build. The flow into the tubing may even stop until enough casing pressure has built up to supply more gas into the well. Conventional systems with standard fixed orifice valves create a resonant repetition of this cycle at some frequency which is a function of the volume and the pressure of the fluids in the casing and the tubing. Cyclic unloading results in an erratic and intermittent flow from the well. The system of the present invention allows control of the rate of injection of gas at the bottom of the well to reduce the elasticity of the system. The present system allows reduction of the pressure head by control of the orifice size of the operating valve.

The system also implements a method of regulating gas lift production by adjusting the opening in the downhole orifice to match the downhole reservoir characteristics of temperature and flow as well as to match the injection characteristics of the gas supply, i.e., the injection gas pressure, injection gas volume and the characteristics of the annulus. This method allows adjustment of the downhole orifice to prevent surging and heading of variations in the actual production of downhole hydrocarbons. Prior systems have been implemented primarily by the slow and tedious replacement of valves downhole with various sizes of valves in order to try to optimize and reduce the surging in such systems. The system of the present invention allows substantially instantaneous adjustment of downhole flow control valves and a much more practical implementation of flow optimization.

By detecting the variation in flow rate out of the tubing and then restricting the flow rate through the valve downhole, i.e. from the casing into the tubing, fluctuations can be minimized. In effect, by varying the downhole valve size in order to get a steady flow rate at the surface at the highest level, the system flow is optimized. In one approach the flow rate is started very slowly and then the size of the valve opening is increased until the fluctuations over a period of time increase above a selected value. Program control over the valve orifice size is used to obtain optimization with this approach. Such optimization programs are implemented by measuring the pressure and/or flow at the surface and/or downhole, to detect variations and then the size of the variable orifice valve is progressively changed from a minimum effective orifice size to the maximum effective orifice to maximize the flow from the well completion.

As also noted above, the system of the present invention enables selectively matching of the orifice sizes in two difference valves controlling the flow into two different tubings from two different production zones so that two different completion zones can be supplied with the appropriate pressure from a single annulus pressure.

It should also be noted that while the monitor and control system used in conjunction with the flow control valve of the present invention has been illustratively shown, other more complex data acquisition systems, such as that shown in U.S. Pat. No. 4,568,933 to McCracken, et al., assigned to the assignee of the present invention and incorporated by reference above, could be used in combination with the flow control valve of the present invention.

It is believed that the operation and construction of the present invention will be apparent from the foregoing description. While the method and apparatus shown and described has been characterized as being preferred, obvious changes and modifications may be made therein without departing from the spirit and scope of the invention as defined in the following claims.

What is claimed is:

1. A system for controlling the flow from a gas lift petroleum production well in which a borehole penetrates at least two spacially separated geological production zones and includes a casing extending from a wellhead to line the borehole and extend into both of said spacially separated production zones and at least two strings of tubing extending in parallel along the interior of the casing from the wellhead and wherein the first string of tubing extends into the region of the first of said spacially separated production zones and the second string of tubing extends into the region of the second of said production zones, said system comprising:

a gas lift valve connected in each one of said strings of tubing with a first valve being associated with said first production zone and a second valve being associated with said second production zone;

a single source of pressurized gas connected to the casing at the wellhead to provide a source of lift gas; and means for independently varying the size of the flow control aperture within each of said first and second gas lift valves to control the production of fluids from each of said first and second production zones.

2. A system for controlling the flow from a gas lift petroleum production well in which a borehole penetrates at least two spacially separated geological production zones as set forth in claim 1 in which each of said gas lift valves includes:

a valve member having a flow input port, a flow discharge port and means for controlling the passage of fluid therebetween, said control means including means capable of varying the size of the passageway between the input port and the discharge port and means for maintaining the size of the passageway at a selected value;

means connected to said valve member for varying the size of said passageway; and means remote from said valve for supplying control signals to said varying means to control said means and select the size of said passageway.

3. A system for controlling the flow from a gas lift petroleum production well in which a borehole penetrates at least two spacially separated geological production zones as set forth in claim 2 which also includes:

means connected to said valve member for continuously producing a signal indicative of the current size of said passageway;

a control unit located at the surface for generating control signals and for monitoring the size of the passageway within a valve member; and a control cable connected from said control unit to each of said gas lift valves for coupling control signals from said control unit to said valves to vary the size of the passageway and to couple said passageway size indicative signals from each valve member to said control unit.

4. A system for controlling the flow from a gas lift petroleum production well in which a borehole penetrates at least two spacially separated geological production zones as set forth in claim 3 in which said control unit also includes means for monitoring downhole pressures and which also includes:

means for generating a signal downhole indicative of the pressure within the tubing in the region of each of said gas lift valves; and means for connecting said control cable to each of said pressure signal generating means.

5. A system for controlling the flow from a gas lift petroleum production well in which a borehole penetrates at least two spacially separated geological production zones and includes a casing extending from a wellhead to line the borehole and extend into both of said spacially separated production zones and at least two strings of tubing extending in parallel along the interior of the casing from the wellhead and wherein the first string of tubing extends into the region of the first of said spacially separated production zones and the second string of tubing extends into the region of the second of said production zones, said system comprising:

a gas lift valve connected in each one of said strings of tubing with a first valve being associated with said first production zone and a second valve being associated with said second production zone;

a single source of pressurized gas connected to the casing at the wellhead to provide a source of lift gas; and means for independently varying the size of the flow control aperture within each of said first and second gas lift valves to control the production of fluids from each of said first and second production zones, said means including, means for monitoring the production flow from each of said strings of tubing at the surface; and means responsive to the volume of production flow from each of said strings of tubing for varying the size of the control aperture in each of said first and second gas lift valves to optimize the flow of production flow through each tubing string to the surface.

6. A method for controlling the flow from a gas lift petroleum production well in which a borehole penetrates at least two spacially separated geological production zones and includes providing a casing extending from a wellhead to line the borehole and extend into both of said spacially separated production zones and at least two strings of tubing extending in parallel along the interior of the casing from the wellhead and wherein the first string of tubing extends into the region of a first of said spacially separated production zones and the second string of tubing extends into the region of the second of said production zones, said method comprising:

providing a gas lift valve connected in each one of said strings of tubing with a first valve being associated with said first production zone and a second valve being associated with said second production zone;

providing a single source of pressurized gas connected to the casing at the wellhead to provide a source of lift gas; and independently varying the size of the flow control aperture within each of said first and second gas lift valves to control the production of well fluids from each of said first and second production zones.

7. A method for controlling the flow from a gas lift petroleum production well in which a borehole penetrates at least two spacially separated geological production zones as set forth in claim 6 in which each of said gas lift valves provided includes a valve member having a flow input port, a flow discharge port and means for controlling the passage of fluid therebetween, said control means including means capable of varying the size of the passageway between the input port and the discharge port and means for maintaining the size of the passageway at a selected value and which includes the additional step of:

supplying control signals to said varying means from a remote location to control said means and select the size of said passageway.

8. A method for controlling the flow from a gas lift petroleum production well in which a borehole penetrates at least two spacially separated geological production zones as set forth in claim 7 which also includes:

producing a continuous signal indicative of the current size of said passageway at said valve member; and providing a control unit located at the surface for generating control signals and for monitoring the size of the passageway within a valve member;

coupling control signals from said control unit to said valves on a control cable to vary the size of the passageway and to couple said passageway size indicative signals from each valve member to said control unit.

9. A method for controlling the flow from a gas lift petroleum production well in which a borehole penetrates at least two spacially separated geological production zones as set forth in claim 8 in which said control unit also includes means for monitoring downhole pressures and which also includes the steps of:

generating a signal downhole indicative of the pressure within the tubing in the region of each of said gas lift valves; and connecting said control cable to each of said pressure signal generating means.

10. A method for controlling the flow from a gas lift petroleum production well in which a borehole penetrates at least two spacially separated geological production zones and includes providing a casing extending from a wellhead to line the borehole and extend into both of said spacially separated production zones and at least two strings of tubing extending in parallel along the interior of the casing from the wellhead and wherein the first string of tubing extends into the region of a first of said spacially separated production zones and the second string of tubing extends into the region of the second of said production zones, said method comprising:

providing a gas lift valve connected in each one of said strings of tubing with a first valve being associated with said first production zone and a second valve being associated with said second production zone;

providing a single source of pressurized gas connected to the casing at the wellhead to provide a source of lift gas; and independently varying the size of the flow control aperture within each of said first and second gas lift valves to control the production of well fluids from each of said first and second production zones, said steps including:

monitoring the production flow from each of said strings of tubing at the surface; and varying the size of the control aperture in each of said first and second gas lift valves in response to the volume of production flow from each of said strings of tubing to optimize the flow of production flow through each tubing string to the surface.

11. A system for controlling the flow from a gas lift petroleum production well which includes a casing extending from a wellhead to line the borehole and extend into a production zone and a string of tubing extending along the interior of the casing from the wellhead into the region of said production zone, said system comprising:

a gas lift valve connected in said string of tubing and being located in the region of said production zone;

a source of pressurized gas connected to the casing at the wellhead to provide a source of lift gas;

means for monitoring the flow of production flow from said tubing at the surface; and means responsive to the rate of production flow from the tubing for varying the size of the flow control aperture within said gas lift valve to control the production of well fluids from said production zone while minimizing the fluctuations in said production flow rate.

12. A system for controlling the flow from a gas lift petroleum production well as set forth in claim 11 in which the means for varying the size of the flow control aperture within said gas lift valve includes:

means for initially selecting a flow control aperture size which produces a production flow from the tubing which has a negligible value of flow rate fluctuation; and means for slowly increasing the size of the flow control aperture until the flow rate fluctuation exceeds a preselected value.

13. A system for controlling the flow from a gas lift petroleum production well as set forth in claim 11 in which each of said gas lift valves includes:

a valve member having a flow input port, a flow discharge port and means for controlling the passage of fluid therebetween, said control means including means capable of varying the size of the passageway between the input port and the discharge port and means for maintaining the size of the passageway at a selected value;

means connected to said valve member for varying the size of said passageway; and means remote from said valve for supplying control signals to said varying means to control said means and select the size of said passageway.

14. A system for controlling the flow from a gas lift petroleum production well as set forth in claim 13 which also includes:

means connected to said valve member for producing a signal indicative of the size of said passageway; and a control unit located at the surface for generating control signals and for monitoring the size of the passageway within a valve member; and a control cable connected from said control unit to said lift valve for coupling control signals from said control unit to said valve to vary the size of the passageway and to couple said passageway size indicative signals from said valve member to said control unit.

15. A system for controlling the flow from a gas lift petroleum production well as set forth in claim 14 in which said control unit also includes means for monitoring downhole pressures and which also includes:

means for generating a signal downhole indicative of the pressure within the tubing in the region of said gas lift valve;

means for connecting said control cable to said pressure signal generating means; and means also responsive to monitored downhole pressure for varying the size of the flow control aperture within said gas lift valve to control the production of well fluids from said string of tubing and minimize the fluctuations in said production flow rate.

16. A method for controlling the flow from a gas lift petroleum production well which includes a casing extending from a wellhead to line the borehole and extend into a production zone and a string of tubing extending along the interior of the casing from the wellhead into the region of said production zone, said method comprising:

providing a gas lift valve connected in said string of tubing and being located in the region of said production zone;

providing a single source of pressurized gas connected to the casing at the wellhead to provide a source of lift gas; and monitoring the flow of production flow from said tubing at the surface;

varying the size of the flow control aperture within said gas lift valve in response to the rate of production flow from the tubing to control the production of well fluids from said string of tubing and minimize the fluctuations in said production flow rate.

17. A method for controlling the flow from a gas lift petroleum production well as set forth in claim 16 in which the step of varying the size of the flow control aperture within said gas lift valve includes the steps of:

initially selecting a flow control aperture size which produces a production flow from the tubing which has a negligible value of flow rate fluctuation; and slowly increasing the size of the flow control aperture until the flow rate fluctuation exceeds a preselected value.

18. A method for controlling the flow from a gas lift petroleum production well as set forth in claim 16 in which each of said gas lift valves includes:

a valve member having a flow input port, a flow discharge port and means for controlling the passage of fluid therebetween, said control means including means capable of varying the size of the passageway between the input port and the discharge port and means for maintaining the size of the passageway at a selected value;

means connected to said valve member for varying the size of said passageway; and means remote from said valve for supplying control signals to said varying means to control said means and select the size of said passageway.

19. A method for controlling the flow from a gas lift petroleum production well as set forth in claim 18 which also includes:

producing a signal indicative of the size of said passageway;

generating control signals and monitoring the size of the passageway within a valve member at a control unit at the surface; and connecting from said control unit to said lift valve a control cable for coupling control signals from said control unit to said valve to vary the size of the passageway and to couple said passageway size indicative signals from said valve member to said control unit.

20. A method for controlling the flow from a gas lift petroleum production well as set forth in claim 19 in which said control unit also includes means for monitoring downhole pressures and which also includes the additional steps of:

generating a signal downhole indicative of the pressure within the tubing in the region of said gas lift valve;

connecting said control cable to said pressure signal generating means; and varying the size of the flow control aperture within said gas lift valve in response to monitored downhole pressure to control the production of well fluids from said string of tubing and minimize the fluctuations in said production flow rate.

21. In a system for monitoring downhole variable parameters within a petroleum production well, comprising:

a control unit located at the surface for producing control signals and for receiving signals indicative of monitored parameter values;

a plurality of sensors located downhole for generating a signal related to the value of a variable parameter;

a cable extending down said well for connecting all of said plurality of sensors to said control unit at the surface;

an address control switch associated with each one of said plurality of sensors and connected to said cable, each one of said address control switches having a unique address code upon receipt of which it will connect its associated sensor to said cable for electrical communication with said control unit; and an address code generator located within said control unit and connected to said cable for selectively generating control signals containing the address code associated with the address control switch of the particular downhole sensor for the downhole parameter to be monitored at the surface.

22. A system for monitoring downhole variable parameters within a petroleum production well as set forth in claim 21 which also includes:

a valve member located downhole and having a flow input port, a flow discharge port and means for controlling the passage of fluid therebetween, said control means including means responsive to control signals capable of varying the size of the passageway between the input port and the discharge port and means for maintaining the size of the passageway at a selected value;

an address control switch associated with said control means within said valve member and said cable and having a unique address code upon receipt of which it will connect said control means to said cable for electrical communication of control signals from said control unit to said control means; and said address code generator located within said control unit also being capable of selectively generating control signals containing the address code of the address control switch associated with the control means within the valve member.

23. A system for monitoring downhole variable parameters within a petroleum production well as set forth in claim 22 which also includes:

means connected to said valve member for producing an indication of the size of the passageway between the input port and the discharge port of said valve member; and one of said plurality of sensors located downhole produces a signal proportional to the output of said indication producing means.

24. A system for monitoring downhole variable parameters within a petroleum production well as set forth in claim 22 in which:

said cable also carries a relatively low voltage d.c. operating current from said control unit to said sensors to provide operating current thereto.

25. A system for monitoring downhole variable parameters within a petroleum production well as set forth in claim 22 in which:

each of said sensors produces a signal indicative of the value of its monitored parameter value which is within a frequency range which is different from the frequency range of the signals of the other sensors.

26. A system for monitoring and controlling downhole parameters within a petroleum production well comprising:

a first electrical component located downhole which requires a relatively low value of operating voltage;

a second electrical component located downhole which requires periodic pulses of a relatively high value of operating voltage;

a single cable extending from the surface for supplying operating voltage to both said first and second electrical components;

first circuit means connected between said cable and said first electrical component for allowing a said relatively low value of voltage to pass and supply operating power to said component and responsive to a value of voltage on said cable in excess of a threshold value for electrically disconnecting said first component from said cable and responsive to the value of voltage on said cable decreasing to zero for reconnecting said first component to said cable; and second circuit means connected between said cable and said second electrical component for disconnecting said component from said cable to prevent said component from electrically loading the power supply circuit and responsive to a value of voltage on said cable in excess of a threshold value for electrically connecting said second component to said cable to allow said voltage to pass and operate said component and responsive to the value of voltage on said cable decreasing to zero for disconnecting said second component to said cable.

27. A system for monitoring and controlling downhole parameters within a petroleum production well as set forth in claim 26, in which:

said first circuit means comprises a voltage sensitive switch including, electronic switch means connected in series with said first component and having a gate for selectively connecting or disconnecting said component from said cable, means for sensing the value of the voltage on the cable, comparing it to a reference value, and producing an output signal if said value is less than said reference value, and means responsive to an output signal from said sensing means for applying a signal to the gate of said electronic switch means and connecting a low voltage operating voltage from said cable to said first electrical component.

28. A system for monitoring and controlling downhole parameters within a petroleum production well as set forth in claim 26, in which:

said electronic switch means includes a field effect transistor.

29. A system for monitoring and controlling downhole parameters within a petroleum production well as set forth in claim 26, in which:

said first electrical component includes a sensor located downhole for generating a signal related to the value of a variable parameter.

30. A system for monitoring and controlling downhole parameters within a petroleum production well as set forth in claim 26, in which said second electrical component includes:

a valve member having a flow input port, a flow discharge port and means for controlling the passage of fluid therebetween, said control means including means capable of varying the size of the passageway between the input port and the discharge port and means for maintaining the size of the passageway at a selected value; and electrical pulse responsive means connected to said valve member for varying the size of said passageway; and means remote from said valve and connected to the upper end of said cable for supplying electrical control pulses to said varying means to control said means and select the size of said passageway.

31. A system for monitoring and controlling downhole parameters within a petroleum production well as set forth in claim 26, in which:

said second circuit means comprises a voltage sensitive switch including, electronic switch means connected in series with said second component and having a gate for selectively connecting or disconnecting said component from said cable, and means for biasing the gate of said electronic switch to a preselected voltage to prevent conduction of said switch unless the voltage on said cable exceeds said preselected voltage.

32. A system for monitoring and controlling downhole parameters within a petroleum production well as set forth in claim 31, in which:

said electronic switch means includes a silicon controlled rectifier.

33. A system for monitoring and controlling downhole parameters within a petroleum production well as set forth in claim 26, in which:

said second electrical component is responsive to electrical pulses of one polarity for one function and to electrical pulses of the opposite polarity for another function;

said second circuit means comprises a voltage sensitive switch including, a first unidirectional electronic switch means connected in series with said second component in a first polarity and having a gate for selectively connecting or disconnecting said component from said cable, a second unidirectional electronic switch means connected in series with said second component in the opposite polarity and said first switch means and having a gate for selectively connecting or disconnecting said component from said cable, means for biasing the gate of said first electronic switch to a preselected voltage of a first polarity to prevent conduction of said switch unless the voltage on said cable exceeds said preselected voltage and polarity, and means for biasing the gate of said second electronic switch to a preselected voltage of the opposite polarity to prevent conduction of said switch unless the voltage on said cable exceeds said preselected voltage and polarity.

34. A system for monitoring and controlling downhole parameters within a petroleum production well as set forth in claim 33, in which:

said second electrical component includes a pair of solenoid coils, one for moving a solenoid armature in one direction and one for moving said solenoid armature in the other direction.

35. A system for monitoring and controlling downhole parameters within a petroleum production well as set forth in claim 33, in which:

said first and second unidirectional switch means include silicon controlled rectifiers.

36. A system for monitoring and controlling downhole parameters within a petroleum production well as set forth in claim 33 in which said second electrical component comprises:

a valve member having a flow input port, a flow discharge port and means for controlling the passage of fluid therebetween, said control means including means capable of varying the size of the passageway between the input port and the discharge port and means for maintaining the size of the passageway at a selected value;

electrical pulse responsive means connected to said valve member for increasing the size of said passageway in response to pulses of one polarity and decreasing the size of the passage in response to pulses of the opposite polarity; and means remote from said valve and connected to the upper end of said cable for selectively supplying electrical control pulses of one polarity or the other to said varying means to control said means and select the size of said passageway.

37. A system for monitoring and controlling downhole parameters within a petroleum production well comprising:

a casing extending from a wellhead to line the borehole and extend into a production zone;

a string of tubing extending along the interior of the casing from the wellhead into the region of said production zone;

a valve connected in said string of tubing and being located in the region of said production zone;

means for varying the size of the flow control aperture within said valve to control the flow of fluids from the casing into the tubing;

means connected to said valve for continuously generating a signal indicative of the current size of the flow control aperture;

a control unit located at the surface for generating control signals and for monitoring the size of the flow control aperture within said valve;

a control cable extending down said casing and connected from said control unit to said valve for coupling control signals from said control unit to said valve to vary the size of the flow control aperture thereof and to couple said size indicative signals from said signal generating means to said control unit for monitoring thereof.

38. A system for monitoring and controlling downhole parameters within a petroleum production well as set forth in claim 37 wherein said control unit includes means for monitoring different variable parameter values and which also includes:

a sensor for generating a signal indicative of pressure located in the region of said valve, said sensor being connected to said control cable for receiving a low voltage power supply signal from said control unit and for sending said pressure indicative signal from said sensor to said control unit.

39. A system for monitoring and controlling downhole parameters within a petroleum production well comprising:

a casing extending from a wellhead to line the borehole and extend into a production zone;

a string of tubing extending along the interior of the casing from the wellhead into the region of said production zone;

a valve connected in said string of tubing and being located in the region of said production zone;

means for varying the size of the flow control aperture within said valve to control the flow of fluids from the casing into the tubing;

means connected to said valve for generating a signal indicative of the size of the flow control aperture;

a control unit located at the surface for generating control signals and for monitoring the size of the flow control aperture within said valve and different variable parameter values;

a control cable extending down said casing and connected from said control unit to said valve for coupling control signals from said control unit to said valve to vary the size of the flow control aperture thereof and to couple said size indicative signals from said signal generating means to said control unit for monitoring thereof;

a sensor for generating a signal indicative of pressure located in the region of said valve, said sensor being connected to said control cable for receiving a low voltage power supply signal from said control unit and for sending said pressure indicative signal from said sensor to said control unit; and a first voltage sensitive switch positioned between said control cable and said sensor for electrically connecting the low voltage power supply signal from said control unit to said sensor and responsive to a relatively higher voltage control signal for varying the size of the flow control aperture of said valve for electrically disconnecting said sensor from said cable to protect the circuitry of said sensor from said higher voltage.

40. A system for monitoring and controlling downhole parameters within a petroleum production well as set forth in claim 39 which also includes:

a second voltage sensitive switch positioned between said control cable and said flow control aperture size indicative signal generating means for electrically connecting a low voltage power supply signal from said control unit to said signal generating means and responsive to a relatively higher voltage control signal for varying the size of the flow control aperture of said valve for electrically disconnecting said signal generating means from said cable to protect the circuitry of said signal generating means from said higher voltage.

41. A system for monitoring and controlling downhole parameters within a petroleum production well as set forth in claim 40 which also includes:

a third voltage sensitive switch positioned between said control cable and said valve flow control aperture size varying means for electrically disconnecting a low voltage power supply signal from said control unit to avoid electrical drain on the power supply and responsive to a relatively higher voltage control signal for varying the size of the flow control aperture of said valve to electrically connect said valve flow control aperture size varying means to said cable.

42. A system for monitoring and controlling downhole parameters within a petroleum production well as set forth in claim 41 which:

said third voltage sensitive switch is also responsive to discontinuance of said relatively higher voltage control signal for electrically disconnecting said valve flow control aperture size varying means from the low voltage power supply signal on said cable.

43. A system for monitoring and controlling downhole parameters within a petroleum production well as set forth in claim 41 in which:

said means for varying the size of the flow control aperture within the valve is responsive to a relatively higher voltage control signal pulse of a one polarity for increasing the size of said aperture and responsive of the opposite polarity for decreasing the size of said aperture.

44. A system for monitoring and controlling downhole parameters within a petroleum production well comprising:

a casing extending from a wellhead to line the borehole and extend into a production zone;

a string of tubing extending along the interior of the casing from the wellhead into the region of said production zone;

a valve connected in said string of tubing and being located in the region of said production zone;

means for varying the size of the flow control aperture within said valve to control the flow of fluids from the casing into the tubing;

means connected to said valve for generating a signal indicative of the size of the flow control aperture;

a control unit located at the surface for generating control signals and for monitoring the size of the flow control aperture within said valve and different variable parameter values;

a control cable extending down said casing and connected from said control unit to said valve for coupling control signals from said control unit to said valve to vary the size of the flow control aperture thereof and to couple said size indicative signals from said signal generating means to said control unit for monitoring thereof;

a sensor for generating a signal indicative of pressure located in the region of said valve, said sensor being connected to said control cable for receiving a low voltage power supply signal from said control unit and for sending said pressure indicative signal from said sensor to said control unit;

means connected between said flow control aperture size indicative signal generating means and said cable for producing a signal within a first range of frequencies; and means connected between said sensor and said cable for producing a signal within a second range of frequencies which excludes frequencies within said first range.

45. A system for monitoring and controlling downhole parameters within a petroleum production well comprising:

a casing extending from a wellhead to line the borehole and extend into a production zone;

a string of tubing extending along the interior of the casing from the wellhead into the region of said production zone;

a valve connected in said string of tubing and being located in the region of said production zone;

means for varying the size of the flow control aperture within said valve to control the flow of fluids from the casing into the tubing;

means connected to said valve for generating a signal indicative of the size of the flow control aperture;

a control unit located at the surface for generating control signals and for monitoring the size of the flow control aperture within said valve and different variable parameter values;

a control cable extending down said casing and connected from said control unit to said valve for coupling control signals from said control unit to said valve to vary the size of the flow control aperture thereof and to couple said size indicative signals from said signal generating means to said control unit for monitoring thereof;

a plurality of sensors for generating signals indicative of associated parameter values, each of said sensors being connected to said control cable for receiving a low voltage power supply signal from said control unit and for sending a parameter value indicative signal to said control unit;

an address control switch associated with each one of said plurality of sensors and connected between said sensors and said cable, each of said address control switches having a unique address code upon receipt of which it will connect its associated sensor to said cable for electrical communication with said control unit; and an address code generator located within said control unit and connected to said cable for selectively generating control signals containing the address code associated with the address control switch of the particular sensor for the parameter to be monitored by the control unit.

46. A system for monitoring and controlling downhole parameters within a petroleum production well as set forth in claim 45 which also includes:

a voltage sensitive switch positioned between said control cable and each of said sensors for electrically connecting the low voltage power supply signal from said control unit to said sensor and responsive to a relatively higher voltage control signal for varying the size of the flow control aperture of said valve for electrically is connecting said sensor from said cable to protect the circuitry of said sensor from said higher voltage.

* * * * *

UNITED STATES PATENT AND TRADEMARK OFFICE

CERTIFICATE OF CORRECTION

PATENT NO. : 5,172,717

DATED : December 22, 1992

INVENTOR(S) : William G. Boyle, John J. Goiffon, Charles M. Pool

It is certified that error appears in the above-indentified patent and that said Letters Patent is hereby corrected as shown below:

Col. 42,
Claim 16, line 44, following "providing a", delete --single--.

Col. 46,
Claim 33, line 24, following "polarity", delete --and-- and insert --from--.

Col. 48,
Claim 42, line 43, following "Claim 41", insert --in--.

Signed and Sealed this

Nineteenth Day of July, 1994

Bruce Lehman

*Attest:*

BRUCE LEHMAN

*Attesting Officer*

*Commissioner of Patents and Trademarks*